US008087947B2

(12) United States Patent
Urano

(10) Patent No.: US 8,087,947 B2
(45) Date of Patent: Jan. 3, 2012

(54) CONNECTOR

(75) Inventor: Tetsu Urano, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 12/985,519

(22) Filed: Jan. 6, 2011

(65) Prior Publication Data

US 2011/0171854 A1 Jul. 14, 2011

(30) Foreign Application Priority Data

Jan. 12, 2010 (JP) ..... 2010-004371

(51) Int. Cl.
*H01R 33/02* (2006.01)

(52) U.S. Cl. ..... 439/232; 439/233; 362/217.01; 362/642

(58) Field of Classification Search ..... 439/232, 439/233, 246, 239, 527, 861; 362/642, 217.01, 362/217.16, 217.17, 2, 17.14
See application file for complete search history.

(56) References Cited

U.S. PATENT DOCUMENTS 6,988,906 B1 * 1/2006 Chen ..... 439/226
7,059,888 B2 * 6/2006 Frappier et al. ..... 439/226
7,347,705 B1 * 3/2008 Huang et al. ..... 439/231
7,473,117 B2 * 1/2009 Miyazono et al. ..... 439/239
7,503,786 B2 * 3/2009 Kato et al. ..... 439/239
7,527,510 B2 * 5/2009 Yoo ..... 439/232
7,530,829 B2 * 5/2009 Yuan et al. ..... 439/232
7,540,750 B2 * 6/2009 Miyazono ..... 439/226
7,628,627 B2 * 12/2009 Lee et al. ..... 439/232
D617,285 S * 6/2010 Urano ..... D13/154
7,806,710 B2 * 10/2010 Hwang ..... 439/239
7,862,191 B2 * 1/2011 Park et al. ..... 362/97.1

FOREIGN PATENT DOCUMENTS

JP 2006-244749 A 9/2006

* cited by examiner

*Primary Examiner* — Briggitte R Hammond
(74) *Attorney, Agent, or Firm* — Holtz, Holtz, Goodman & Chick, PC

(57) ABSTRACT

A connector which has a high level of contact stability. An operation member is formed by blanking and bending a metal plate. First and second linking portions that are disposed in a manner opposed to each other to connect a pair of operation portions are in an arrangement in which the first and second linking portions sandwich a pair of operation portions when the operation member is in a developed state. When the operation member is in a completed state, the first and second linking portions connecting the are bent at right angles with respect to the pair of operation portions, respectively.

15 Claims, 26 Drawing Sheets

CONNECTOR

BACKGROUND OF THE INVENTION

1. Field of the Invention

This invention relates to a connector.

2. Description of the Related Art

Conventionally, there has been proposed a connector for backlight (hereinafter referred to as a "backlight connector") which comprises a main body and a slider (see Japanese Laid-Open Patent Publication (Kokai) No. 2006-244749 (Paragraphs 0014 to 0017, and FIGS. 2 and 3)).

The main body includes a pair of contacts, a plate portion, a pair of guide portions and a pair of side plates. Each contact has elasticity. Each contact is substantially U-shaped in plan view, and has an outer wall portion and an inner wall portion. The outer wall portion has an outer surface thereof formed with a protuberance which protuberates outward. The plate portion receives a fluorescent tube. The guide portions rise from opposite side edges of the plate portion, respectively. Each side plate is formed with a long narrow slot. The slot extends in a direction of the height of the main body. The outer wall portion of each contact extends from one end of the associated guide portion.

The slider is substantially U-shaped in plan view, and includes a pair of side wall portions. The pair of side wall portions are connected by a connection plate portion. Each side wall portion includes a rising piece which protrudes inward of the slider. The rising piece is vertically movably inserted through the slot of the guide portion. This mounts the slider to the main body in a vertically movable manner. Each side wall portion includes a pressing plate portion. The pressing plate portion extends from an upper end of the side wall portion.

The connection plate portion connecting the pair of side wall portions is substantially U-shaped as viewed from the front. An upper end portion of the connection plate portion is formed with a pair of flanges which protrudes inward toward each other. When the slider mounted on the main body is at a high position, the pair of flanges do not press the respective protuberances of the pair of contacts. When the slider mounted on the main body is at a low position, the pair of flanges press the protuberances of the pair of contacts such that the pair of contacts are made closer toward each other.

Backlight connectors thus configured are mounted on a connector mounting board.

To connect fluorescent tubes to backlight connectors, first, a plurality of fluorescent tubes are held by a holder having protruding pieces.

Next, the slider mounted on the main body of each backlight connector is moved upward to the high position. Once the slider is moved to the high position, even though the slider moves downward, the flanges of the connection plate portion of the slider are brought into abutment with the protuberances of the contacts, which prevents the slider from moving further downward.

Thereafter, the holder holding the plurality of fluorescent tubes is disposed above the backlight connectors, and is then moved down from the position. At this time, one end of each fluorescent tube is placed on the plate portion associated therewith, and the associated one of the protruding pieces of the holder presses the pressing plate portions of the slider downward, so that the slider is pushed down. As the slider is pushed down, the pair of flanges of the slider press the protuberances of the pair of contacts, whereby the space between the pair of contacts is made narrower. As a result, a conductor of each fluorescent tube is sandwiched by the pair of contacts, whereby each fluorescent tube is electrically connected to the connector mounting board via the backlight connector.

In the above-described backlight connector, the pair of flanges of the slider pushed down press the pair of contacts, whereby continuity between the contacts and the conductor of each fluorescent tube is maintained. However, since the connection plate portion is substantially U-shaped as viewed from the front, the connection plate portion can be deformed by reaction force when the pair of flanges of the slider press the pair of contacts, which sometimes increase the space between the pair of flanges.

Therefore, there is a fear that the contact stability between the contacts of the above-described backlight connector and the conductor of each fluorescent tube is lowered.

SUMMARY OF THE INVENTION

The present invention has been made in view of these circumstances, and an object thereof is to provide a connector which makes it possible to maintain contact stability between an object to be connected and a contact.

To attain the above object, the present invention provides a connector comprising a contact that includes a pair of contact portions which are arranged in a manner opposed to each other in a first predetermined direction, and are capable of holding a terminal portion of an object to be connected, in a sandwiching manner, an operation member that accommodates the pair of contact portions and operates the pair of contact portions, the operation member including a pair of operation portions that are arranged in a manner opposed to each other in the first predetermined direction, a first linking portion that has a cutout enabling the terminal portion of the object to be connected to be inserted between the pair of contact portions in a second predetermined direction which is perpendicular to the first predetermined direction, and links the pair of operation portions, a second linking portion that is opposed to the first linking portion in a third predetermined direction which is perpendicular to the first and second predetermined directions, and links the pair of operation portions, and a pair of pressing portions that are connected to the operation portions, respectively, and are arranged in a manner opposed to each other in the first predetermined direction, for pressing the pair of contact portions to cause the pair of contact portions to be made close to each other such that the pair of contact portions hold the terminal portion of the object to be connected in a sandwiching manner, when the operation member is moved from a first predetermined position to a second predetermined position, and a supporting member that supports the operation member in a manner movable between the first predetermined position and the second predetermined direction in which the pair of pressing portions cause the pair of contact portions to be made close to each other.

With the arrangement of the connector according to the present invention, the pair of operation portions connected to the pair of pressing portions are linked by the first linking portion and the second linking portion, which are opposed to each other, and hence reaction force from the contact, which acts on the pair of pressing portions, is dispersed through the first linking portion and the second linking portion via the pair of operation portions. As a result, the space between the pressing portions is less liable to be increased.

Preferably, each operation portion and each pressing portion are connected by engaging each operation portion and each pressing portion.

Preferably, each pressing portion and each operation portion are connected by integrally forming the pressing portion and the operation portion such that the pressing portion extends from the operation portion.

Preferably, the contact includes a connection portion that is connected to another object to be connected, and the contact and the supporting member are integrally formed by blanking and bending a metal plate.

Preferably, the contact includes a connection portion that is connected to another object to be connected, and the supporting member is formed of an insulator.

Preferably, the operation member is formed by blanking and bending a metal plate.

More preferably, when the operation member is in a developed state, the first and second linking portions are disposed in an arrangement in which the first and second linking portions sandwich the pair of operation portions, and when the operation member is in a completed state, the first and second linking portions are bent at right angles with respect to the pair of operation portions, respectively.

According to this invention, it is possible to maintain the contact stability between the object to be connected and the contact.

The above and other objects, features and advantages of the present invention will become more apparent from the following detailed description taken in conjunction with the accompanying drawings.

DETAILED DESCRIPTION OF THE PREFERRED EMBODIMENTS

The present invention will now be described in detail with reference to the drawings showing preferred embodiments thereof.

A description will be given of a connector according to a first embodiment of the present invention with reference to FIGS. 1 to 13.

Figure 1:
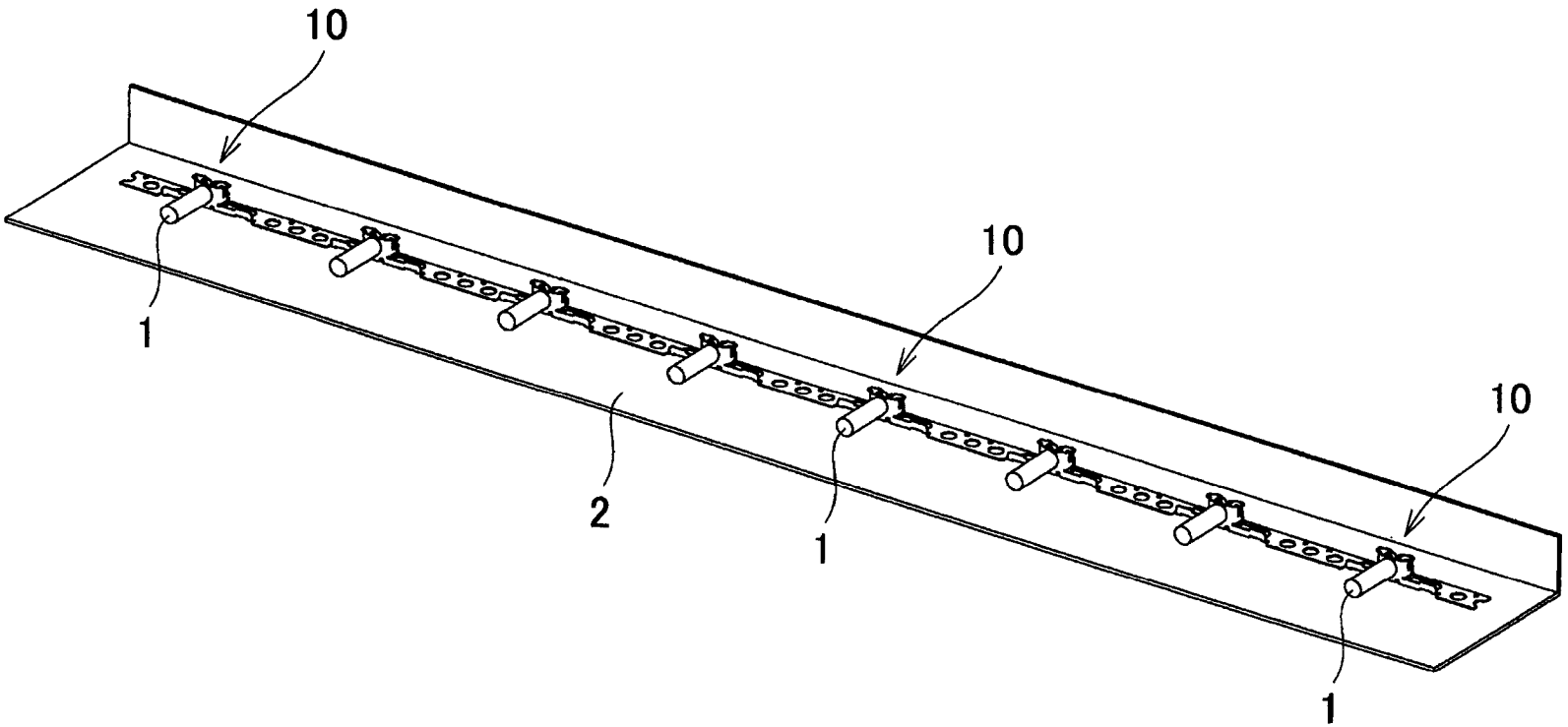
FIG. 1 is a perspective view of connectors according to a first embodiment of the present invention in a state of use.

As shown in FIG. 1, connectors 10 are fixed on a chassis (another object to be connected) 2 at equally-spaced intervals. The connectors 10 electrically connect fluorescent tubes (object to be connected) 1 and the chassis 2.

Figure 2:
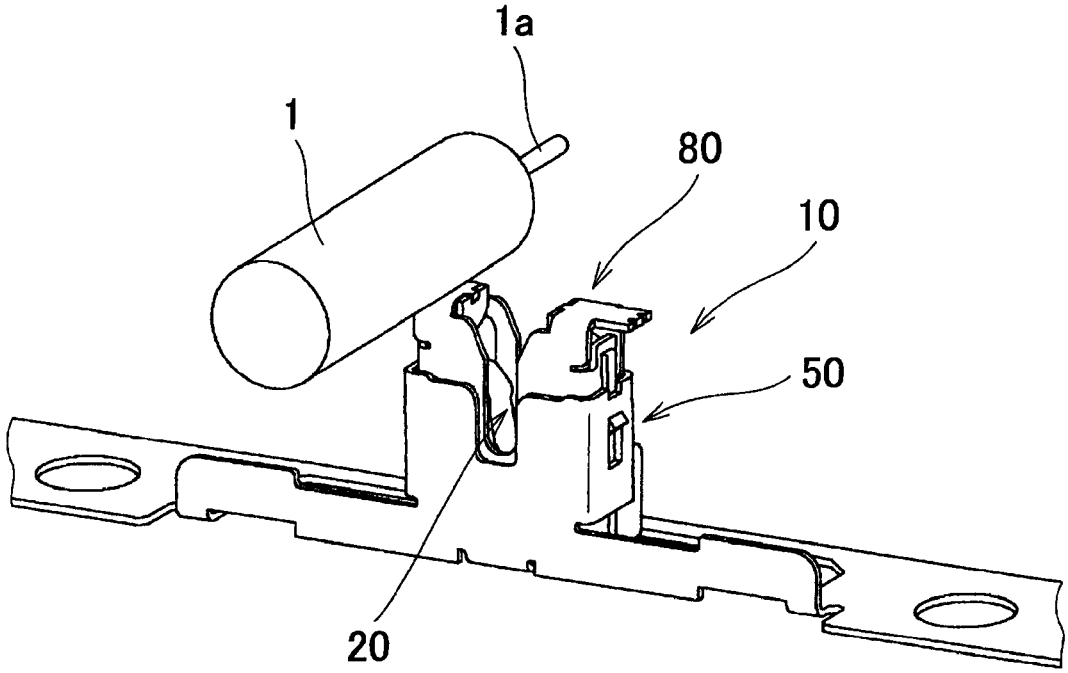
FIG. 2 is a perspective view of a fluorescent tube and a connector appearing in FIG. 1 in a state before the fluorescent tube is connected to the connector appearing in FIG. 1.
Figure 3:
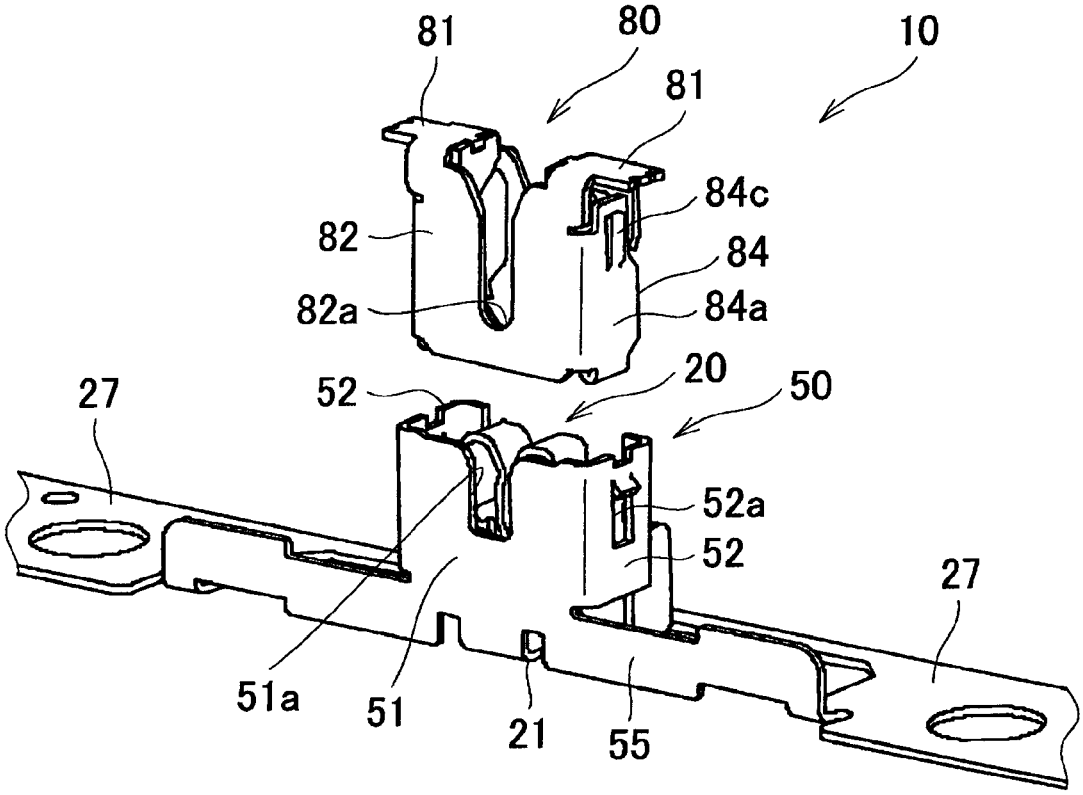
FIG. 3 is a perspective view of an operation member and a housing of the connector appearing in FIG. 1 in a state in which the former is removed from the latter, as viewed from the front.

As shown in FIGS. 2 and 3, each connector 10 is comprised of a contact 20, a housing (supporting member) 50, and an operation member 80.

Figure 4:
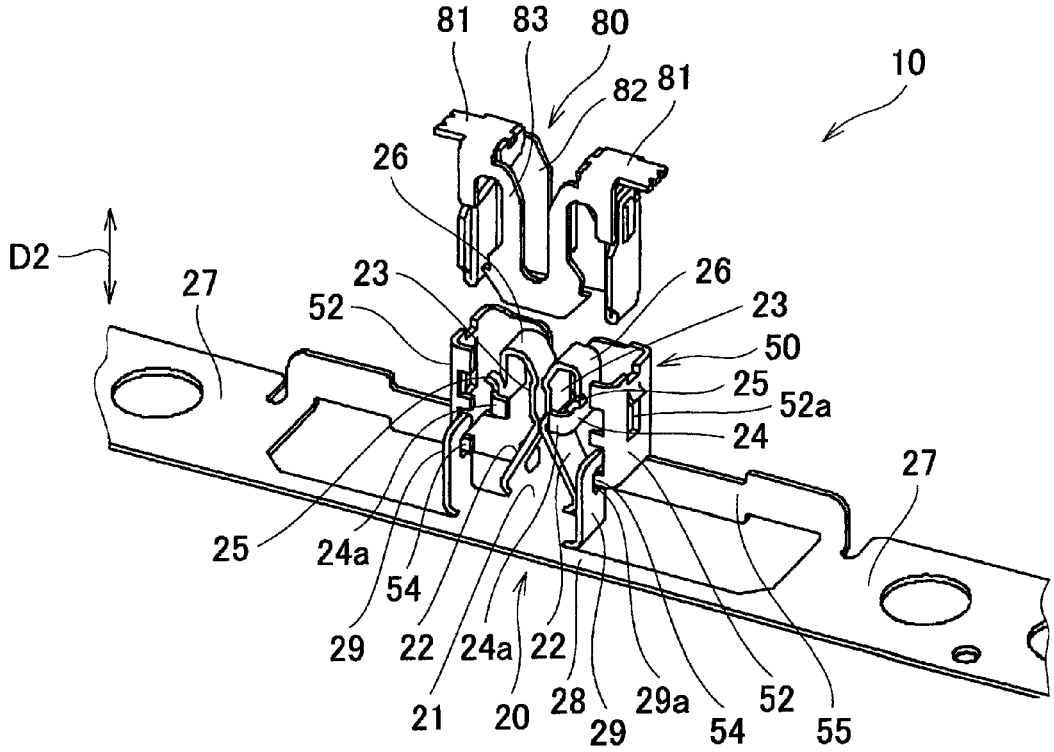
FIG. 4 is a perspective view of the operation member and the housing of the connector in the state in which the former is removed from the latter, as viewed from the rear.
Figure 12:
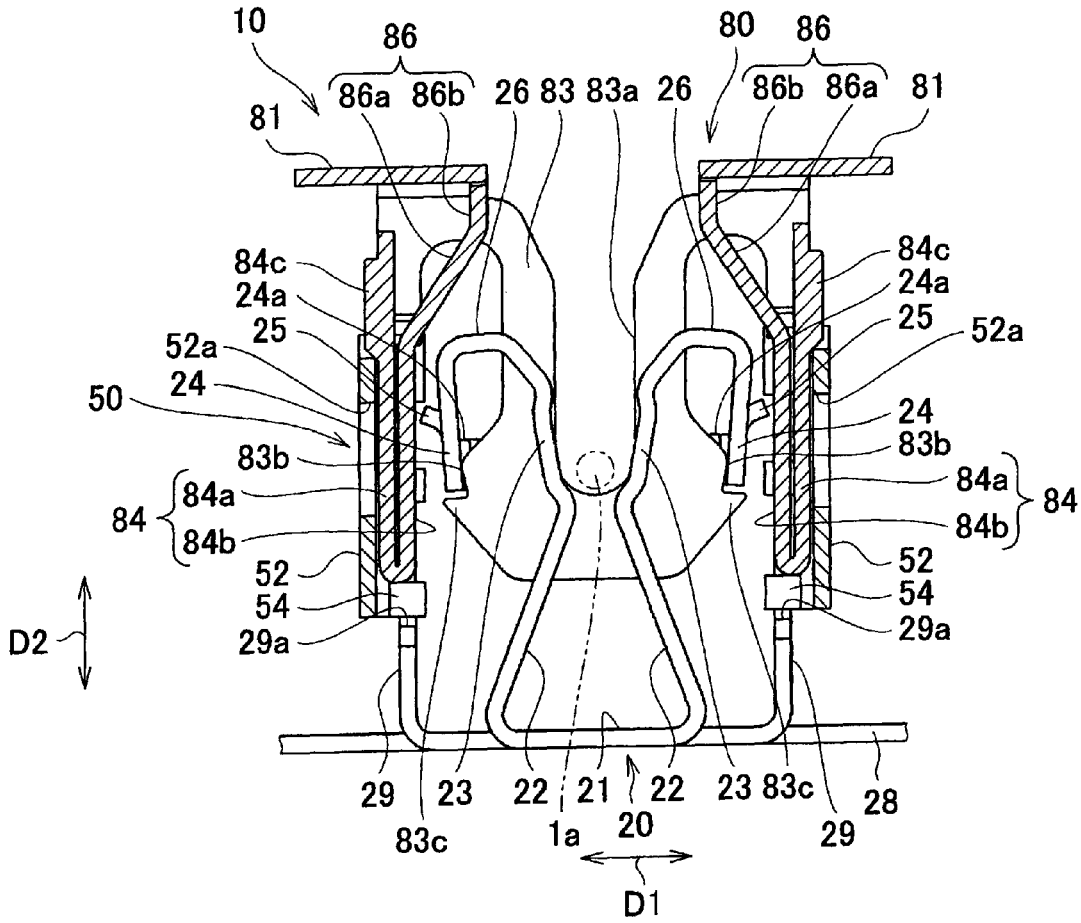
FIG. 12 is an enlarged cross-sectional view of the connector appearing in FIG. 1 as viewed when the operation member of the connector is in a first predetermined position.

As shown in FIGS. 4 and 12, the contact 20 includes a bottom plate portion 21, a pair of spring portions 22, a pair of contact portions 23, a pair of engaging portions 24, a pair of guide portions 25, a pair of linking portions 26, a pair of connection portions 27, a linking portion 28, and a pair of supporting portions 29.

The bottom plate portion 21 is placed on the chassis 2. The pair of spring portions 22 are continuous with the bottom plate portion 21, and extend upward (upward in FIG. 12 showing the connector 10). The pair of contact portions 23 are continuous with the respective spring portions 22. The pair of engaging portions 24 are capable of being engaged with the operation member 80. Each engaging portion 24 is bent into a substantially L-shape. One end of each engaging portion 24 has a pressing portion 24*a* (see FIG. 11). The pair of guide portions 25 are each curved, and are continuous with the respective engaging portions 24. The pair of linking portions 26 are each substantially U-shaped, and link the respective engaging portions 24 and contact portions 23. The pair of connection portions 27 are mechanically and electrically connected to the chassis 2 by bolts and nuts (neither of which is shown). The linking portion 28 connects the bottom plate portion 21 and the pair of connection portions 27. The pair of supporting portions 29 are continuous with the bottom plate portion 21, and extend upward. The pair of supporting portions 29 each have an upper portion formed with a cutout 29*a*.

The connection portion 27 of one of connectors 10 adjacent to each other is continuous with the connection portion 27 of the other of the connectors 10.

Further, as shown in FIG. 3, the housing 50 and the contact 20 are collectively formed by blanking and bending a metal plate. The housing 50 includes a front portion 51, a pair of side portions 52, and a linking portion 55. A cutout 51*a* is formed in a central portion of the front portion 51. The cutout 51*a* extends in a vertical direction D2 of the housing 50. The cutout 51*a* makes it possible to insert a terminal portion 1*a* of each fluorescent tube 1 into the housing 50 in the vertical direction D2 (see FIG. 10). The pair of side portions 52 are continuous with opposite sides of the front portion 51, respectively. The side portions 52 are each formed with a slot 52*a*. The slot 52*a* extends in the vertical direction D2. The linking portion 55 connects the pair of connection portions 27 and the front portion 51 (see FIG. 3). The side portions 52 each have three protrusions 54 formed on a portion thereof toward the supporting portion 29 at predetermined intervals in the vertical direction D2 (see FIGS. 4 and 11). The angles formed by the respective three protrusions 54 and the side portion 52 are substantially equal to a right angle. The protrusions 54 at the lowest location are inserted in the respective cutouts 29*a* of the supporting portions 29. As a result, the housing 50 is supported by the supporting portions 29.

Figure 5:
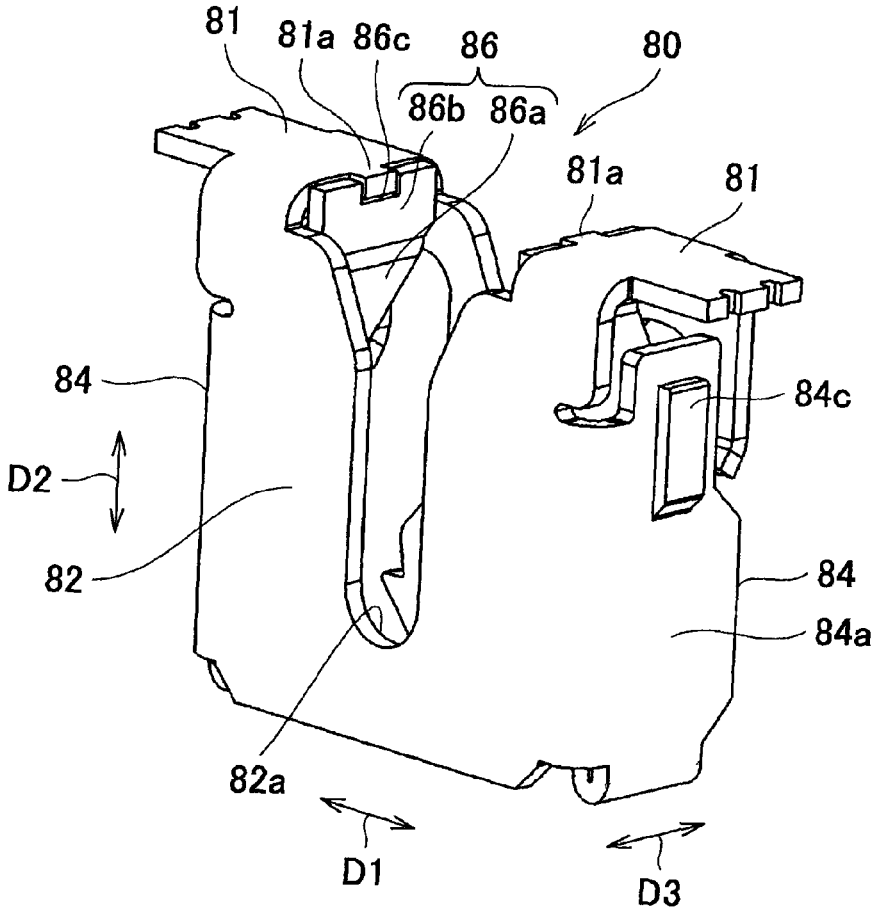
FIG. 5 is a perspective view of the operation member of the connector appearing in FIG. 1, as viewed from the front.
Figure 6:
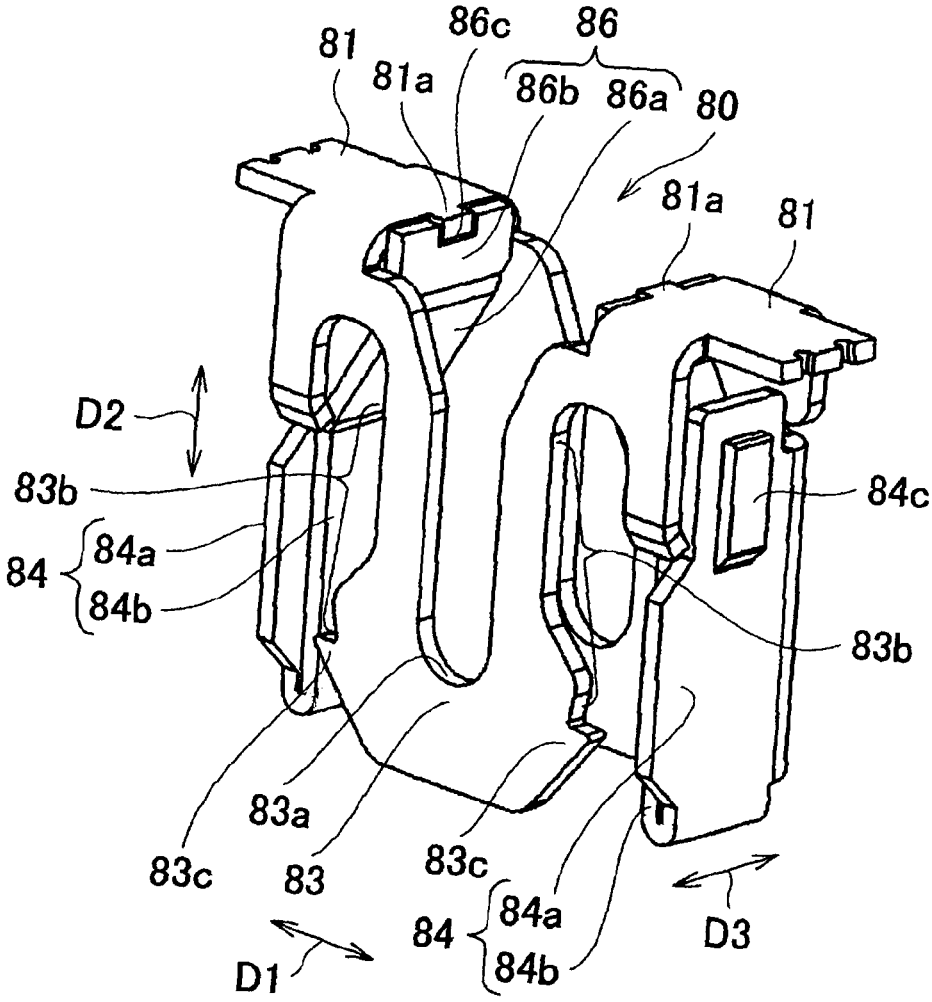
FIG. 6 is a perspective view of the operation member of the connector appearing in FIG. 1 as viewed from the rear.
Figure 8:
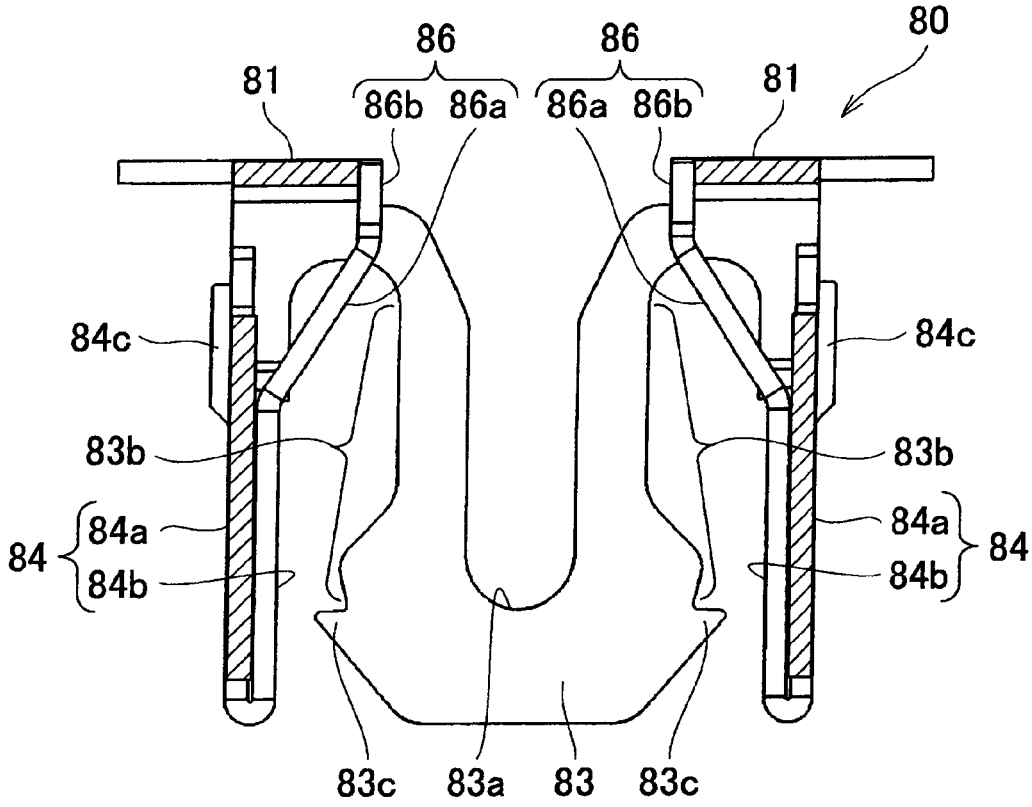
FIG. 8 is a cross-sectional view taken along line VIII-VIII in FIG. 7.

As shown in FIGS. 5, 6, and 8, the operation member 80 includes a pair of operation portions 81, a first linking portion 82, a second linking portion 83, a pair of side portions 84, and a pair of pressing portions 86. The operation member 80 is formed by blanking and bending a metal plate.

The pair of operation portions 81 are disposed opposed to each other in a horizontal (horizontal as viewed in FIG. 12 showing the connector 10) direction (first predetermined direction) D1. The operation portions 81 each have a substantially rectangular shape. The operation portions 81 each have a protrusion 81*a*.

The first linking portion 82 includes a cutout 82*a*. The first linking portion 82 is substantially U-shaped as viewed from the front. The cutout 82*a* extends in the vertical (vertical as viewed in FIG. 12 showing the connector 10) direction (second predetermined direction) D2 of the operation member 80. The cutout 82*a* makes it possible to insert the terminal portion 1*a* of each fluorescent tube 1 into the operation member 80 in the vertical direction D2, and at the same time positions the terminal portion 1*a* inserted in the operation member 80 (see FIG. 10). The first linking portion 82 links the pair of operation portions 81.

Figure 7:
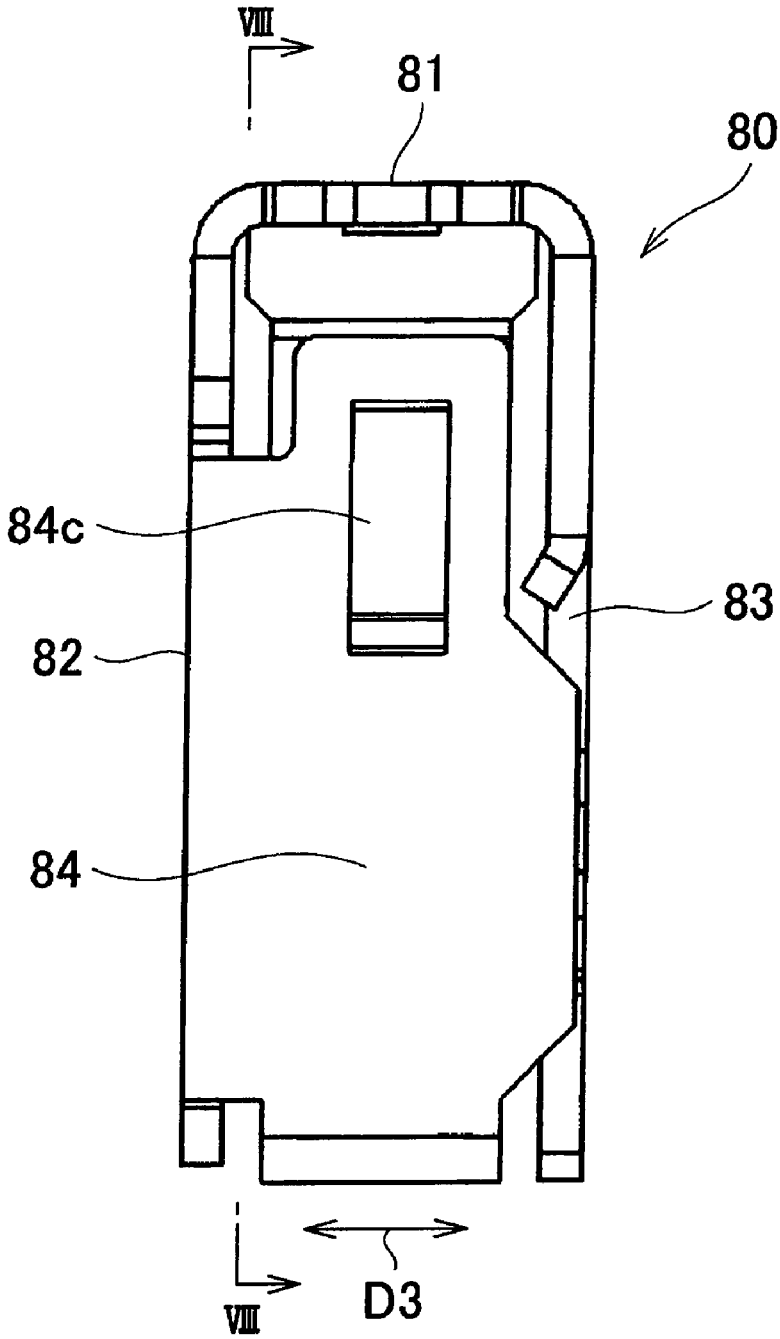
FIG. 7 is a side view of the operation member shown in FIG. 5.

The second linking portion 83 includes a cutout 83*a*. The second linking portion 83 is substantially U-shaped as viewed from the front. The cutout 83*a* extends in the vertical direction D2 of the operation member 80. The cutout 83*a* makes it possible to insert the terminal portion 1*a* of each fluorescent tube 1 into the operation member 80 in the vertical direction D2, and at the same time positions the terminal portion 1*a* inserted in the operation member 80 in cooperation with the cutout 82*a* (see FIG. 10). The opposite side surfaces of the second linking portion 83 are formed as cam faces 83*b*, and a pair of lugs 83*c* are formed on a lower portion of the second linking portion 83. The second linking portion 83 links the pair of operation portions 81. The second linking portion 83 is opposed to the first linking portion 82 in a front-rear (left and right sides of the operation member 80 as viewed in FIG. 7 are the front and the rear, respectively) direction (third predetermined direction) D3.

The pair of side portions 84 are each bent in an overlapping manner (see FIG. 6), and the angles formed by the respective side portions 84 and the first linking portion 82 are substantially equal to a right angle. Each side portion 84 has an outer portion 84*a* and an inner portion 84*b*. The outer portion 84*a* is continuous with the first linking portion 82. The outer portion 84*a* is formed with a protuberance 84*c*. The protuberance 84*c* extends in the vertical direction D2.

The pair of pressing portions 86 each include an inclined portion 86*a* and a vertical portion 86*b*. The inclined portion 86*a* is continuous with a top end of the inner portion 84*b* of the side portion 84. The inclined portion 86*a* is inclined with respect to the inner portion 84*b*. The vertical portion 86*b* is connected to a top end of the inclined portion 86*a*, and is substantially parallel to the inner portion 84*b*. A top end portion of the vertical portion 86*b* is formed with a recess 86*c*. The protrusion 81*a* of the operation portion 81 is fitted in the recess 86*c*. This causes the operation portion 81 and the pressing portion 86 to be engaged with and connected to each other.

Figure 9:
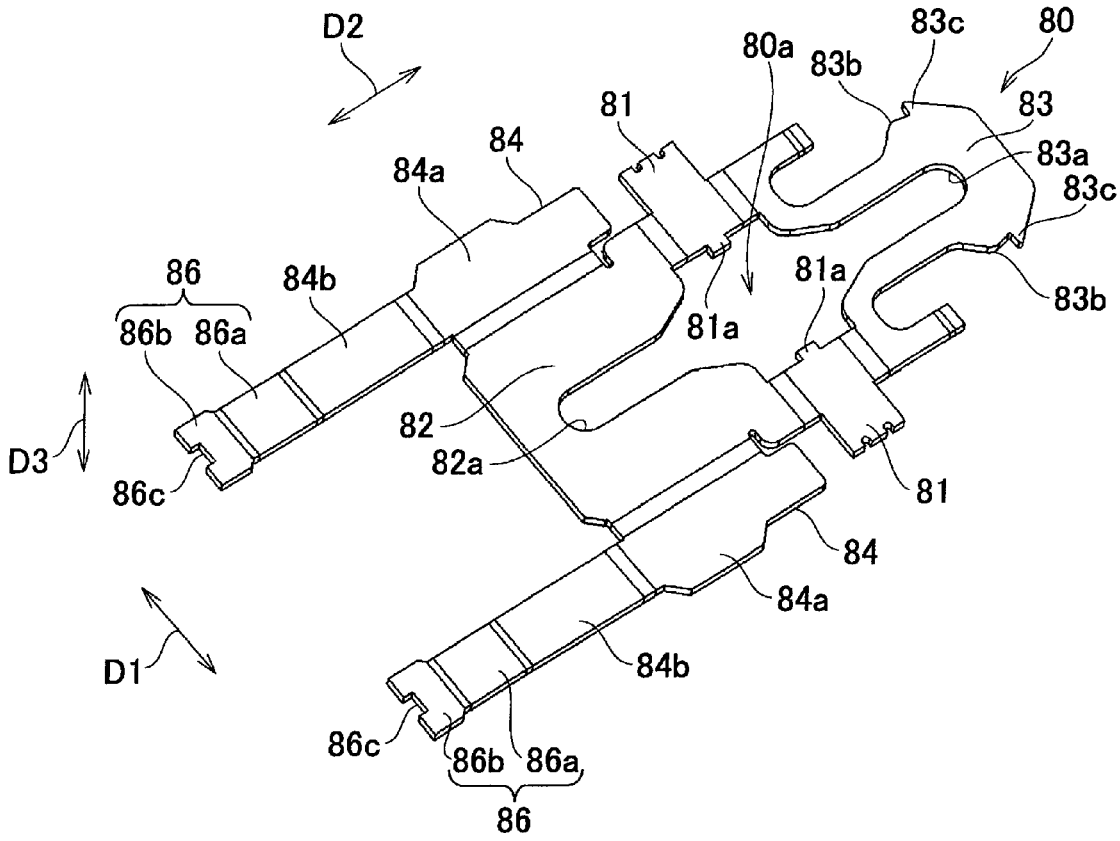
FIG. 9 is a development view of the operation member shown in FIG. 5.
Figure 10:
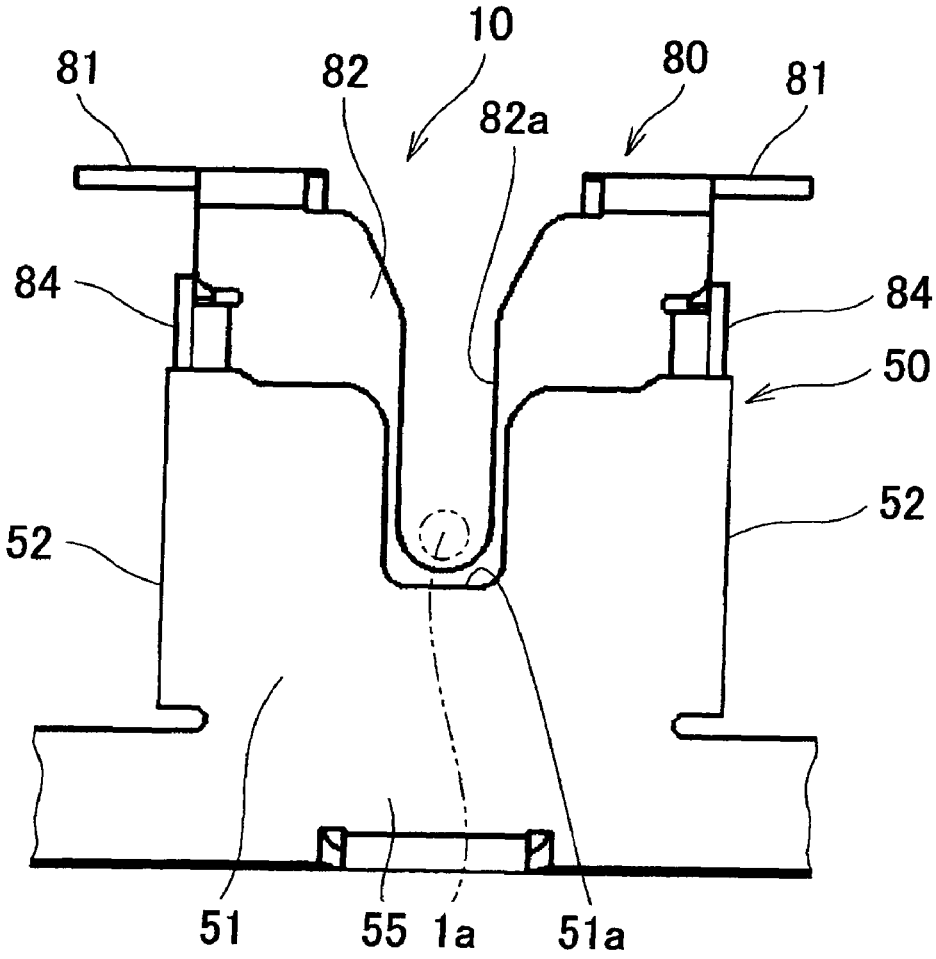
FIG. 10 is an enlarged front view of the connector appearing in FIG. 1.

As shown in FIG. 9, when the operation member 80 is developed, the first linking portion 82 and the second linking portion 83 are arranged in a manner sandwiching the pair of operation portions 81, whereby a substantially cross-shaped hole 80*a* is formed in the central portion of the operation member 80. When the operation member 80 is bent into a substantially U-shape, as shown in FIG. 7, the hole 80*a* forms a space between the cutouts 82*a* and 83*a* and the pair of operation portions 81.

A description will be given of a process for bending the operation member 80.

First, the inner portions 84*b* are folded back so as to overlap the respective outer portions 84*a*. Next, the inclined portions 86*a* and the vertical portions 86*b* are folded in a direction away from the respective outer portions 84*a* such that the inclined portions 86*a* are inclined with respect to the respective inner portions 84*b*. Thereafter, the vertical portions 86*b* are folded in a direction closer toward the respective outer portions 84*a* so as to make the vertical portions 86*b* parallel to the inner portions 84*b*.

Next, as shown in FIG. 7, the first linking portion 82 and the second linking portion 83 are bent at rights angle with respect to the operation portion 81 such that the first linking portion 82 and the second linking portion 83 are opposed to each other in the front-rear direction D3. As a result, as shown in FIGS. 5 and 6, the protrusions 81*a* of the operation portions 81 are fitted in the recesses 86*c* of the pressing portions 86.

To mount the operation member 80 in the housing 50, as shown in FIGS. 3 and 4, it is only necessary to insert the operation member 80 in the housing 50 from above the housing 50. At this time, the guide portions 25 of the contact 20 guide the second linking portion 83 of the operation member 80 between the pair of engaging portions 24 of the contact 20, and hence the operation member 80 is mounted in the housing 50 with ease.

Figure 11:
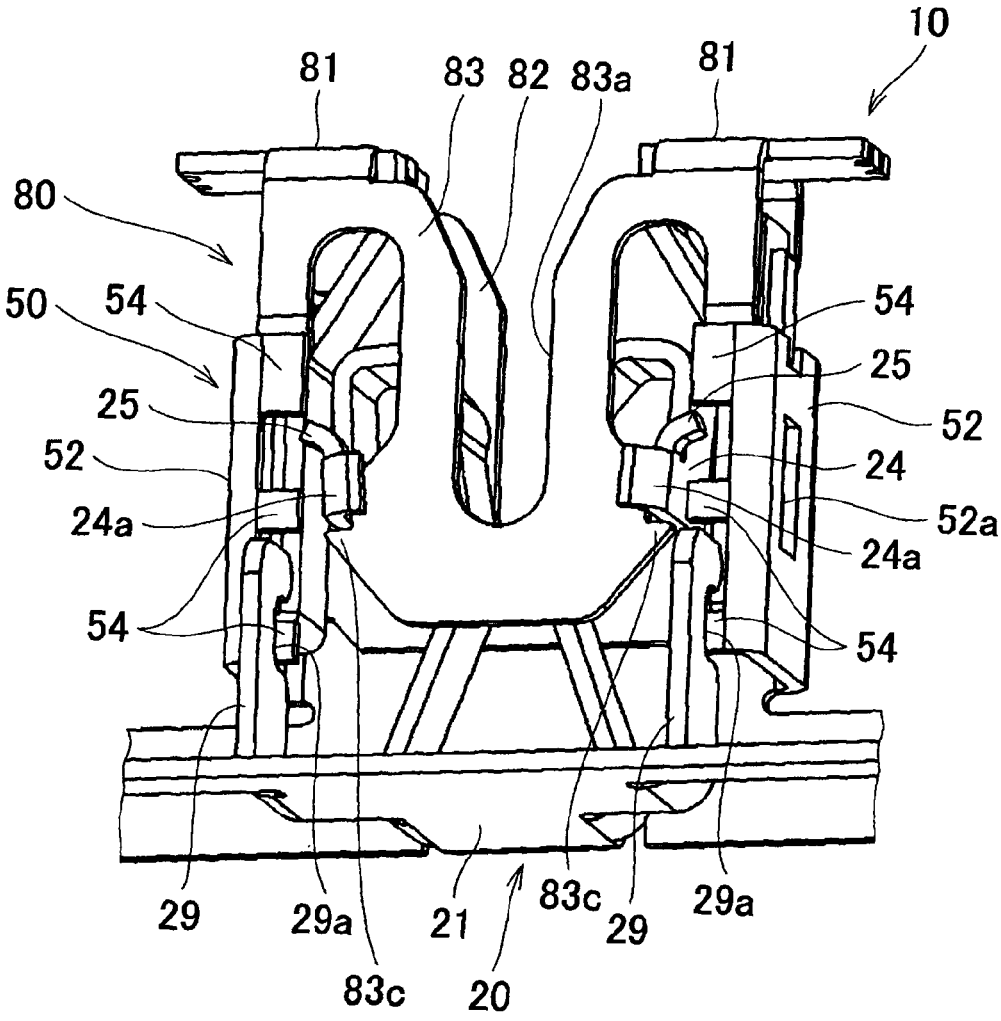
FIG. 11 is an enlarged perspective view of the connector appearing in FIG. 1 as viewed from the rear.

To connect the fluorescent tube 1 to the connector 10, first, the operation member 80 is pulled upward by holding the operation portions 81. Then, as shown in FIGS. 11 and 12, the lugs 83*c* of the operation member 80 are brought into abutment with the engaging portions 24 of the contact 20, whereby the operation member 80 stops at a first predetermined position (position where the pair of contact portions 23 are remote from each other). At this time, the cam faces 83*b* of the second linking portion 83 of the operation member 80 press the engaging portions 24 of the contact 20, and hence the space between the pair of contact portions 23 is widened.

When the operation member 80 is in the first predetermined position, even if the operation portions 81 are released, the lower ends of the protrusions 84*c* of the operation member 80 come into abutment with the upper ends of the side portions 52 of the housing 50 (see FIG. 12), which prevents the operation member 80 from moving downward.

When the operation member 80 is in the first predetermined position, the terminal portion 1*a* of the fluorescent tube 1 is inserted between the pair of contact portions 23.

Figure 13:
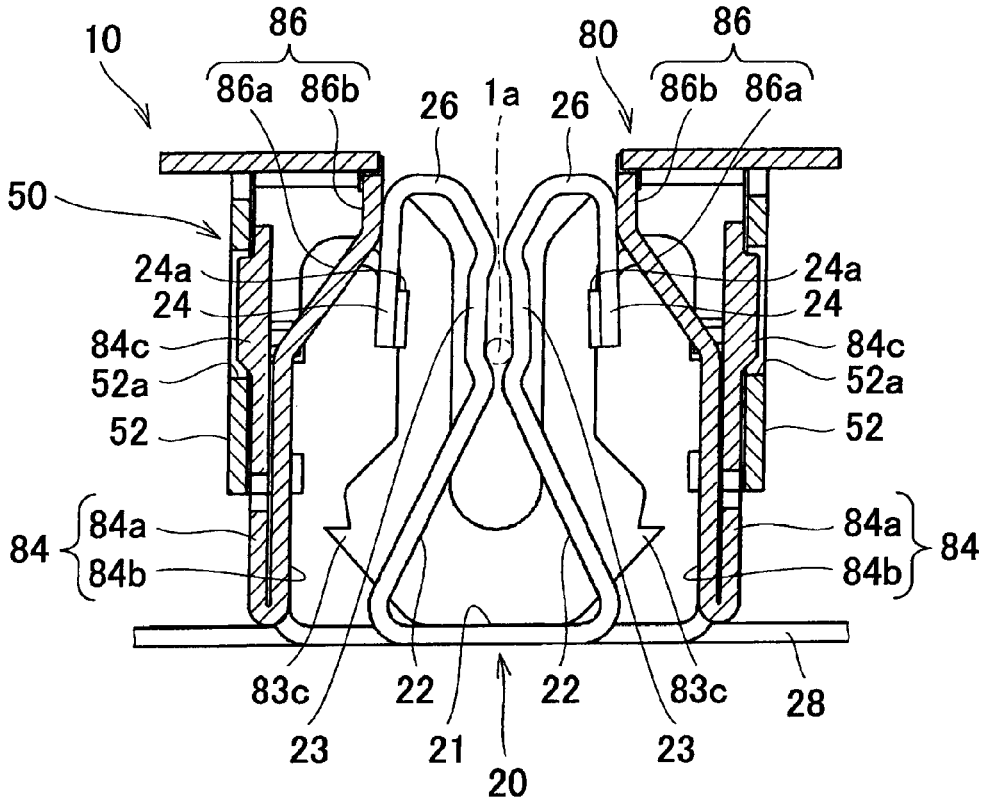
FIG. 13 is an enlarged cross-sectional view of the connector appearing in FIG. 1 as viewed when the operation member of the connector is in a second predetermined position.

Finally, the operation member 80 is pushed downward by pressing the operation portions 81 of the operation member 80 downward. At this time, the protrusions 84*c* of the operation member 80 press the side portions 52 of the housing 50, whereby the space between the two side portions 52 is widened, and the entire protrusions 84*c* enter the housing 50. When the protrusions 84*c* of the operation member 80 are fitted in the slots 52*a* of the side portions 52 of the housing 50, as shown in FIG. 13, the operation member 80 stops at a second predetermined position (position where the pair of contact portions 23 are made close to each other). During this process, the linking portions 26 of the contact 20 are pressed by the inclined portions 86*a* of the pressing portions 86 of the operation member 80, whereby the space between the two contact portions 23 is made narrower, and finally the vertical portions 86*b* of the pressing portion 86 are brought into contact with the linking portions 26, respectively, with the terminal portion 1*a* being held by the pair of contact portions 23 in a sandwiched manner. As a result, the fluorescent tube 1 becomes electrically continuous with the connector 10, thereby being electrically connected to the chassis 2 via the connector 10. At this time, although the pressing portions 86 of the operation member 80 are subjected to a load from the linking portions 26 of the contact 20, the load is dispersed to the first linking portion 82 and the second linking portion 83 in directions perpendicular to the direction of thickness of the first and second linking portions 82 and 83, and hence the space between the two pressing portions 86 is hardly widened.

According to the present embodiment, when the fluorescent tube 1 is connected to the connector 10, the space between the pair of pressing portions 86 is hardly widened, whereby it is possible to obtain stable contact state between the fluorescent tube 1 and the contact 20.

Further, since the contact 20 and the housing 50 are formed by blanking and bending a metal plate, and the operation member 80 is formed by blanking and bending a metal plate, it is possible to produce the connector 10 at low costs.

Since the operation member 80 moves in the vertical direction D2, as compared with a connector which slides the operation member in a longitudinal direction of the fluorescent tube 1, the connector 10 has plenty allowance space for operating the operation member 80, so that during assembly of the backlight, a process including handling the operation member 80 can be performed using an automatic assembly machine (not shown).

Next, a description will be given of a connector according to a second embodiment of the present invention with reference to FIGS. 14 to 22.

Component parts identical to those of the connector according to the first embodiment are designated by identical reference numerals, and detailed description thereof is omitted, while only main component parts different in construction from those of the first embodiment will be described hereinafter.

Figure 14:
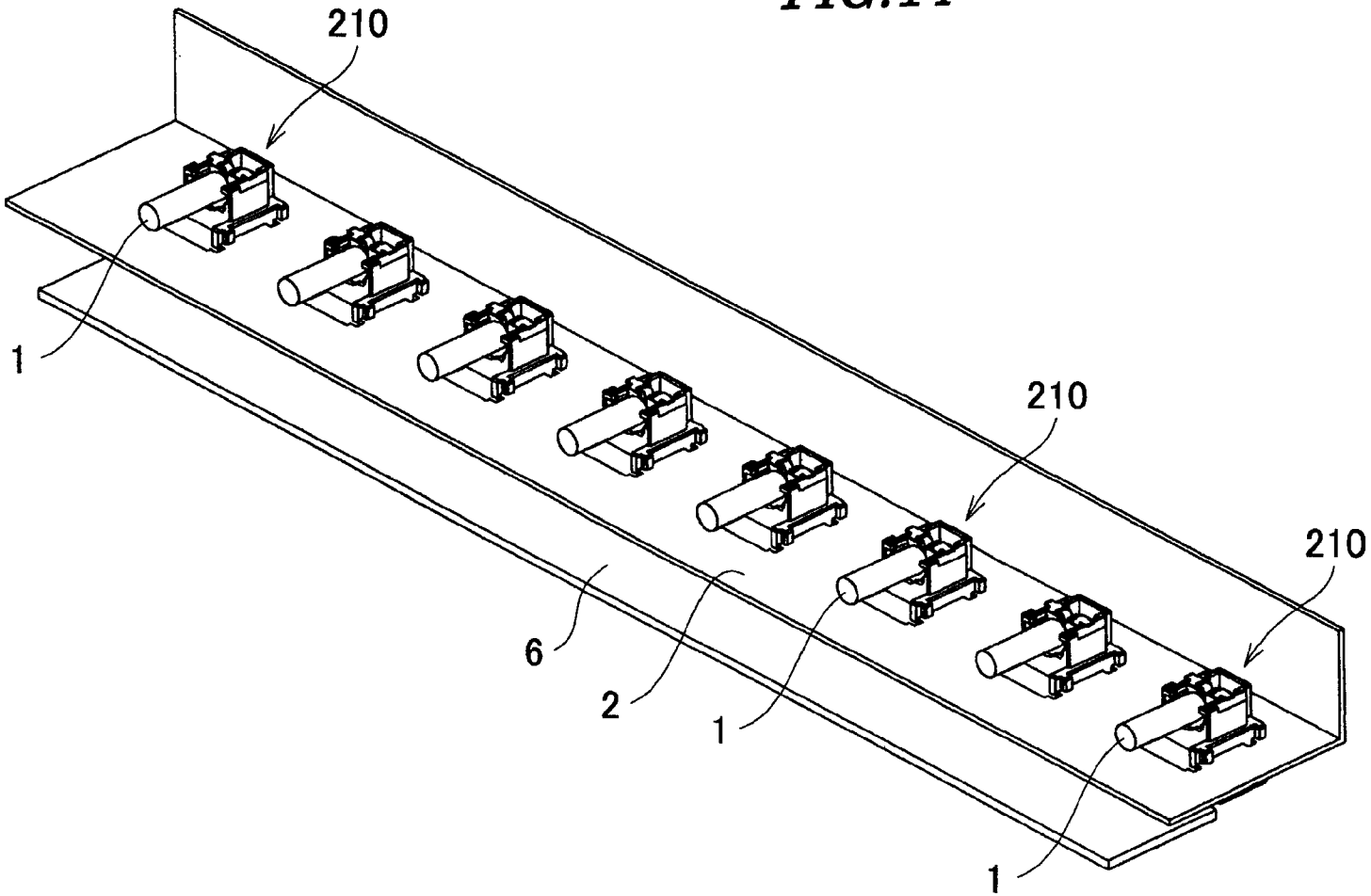
FIG. 14 is a perspective view of connectors according to a second embodiment of the present invention in a state of use.
Figure 15:
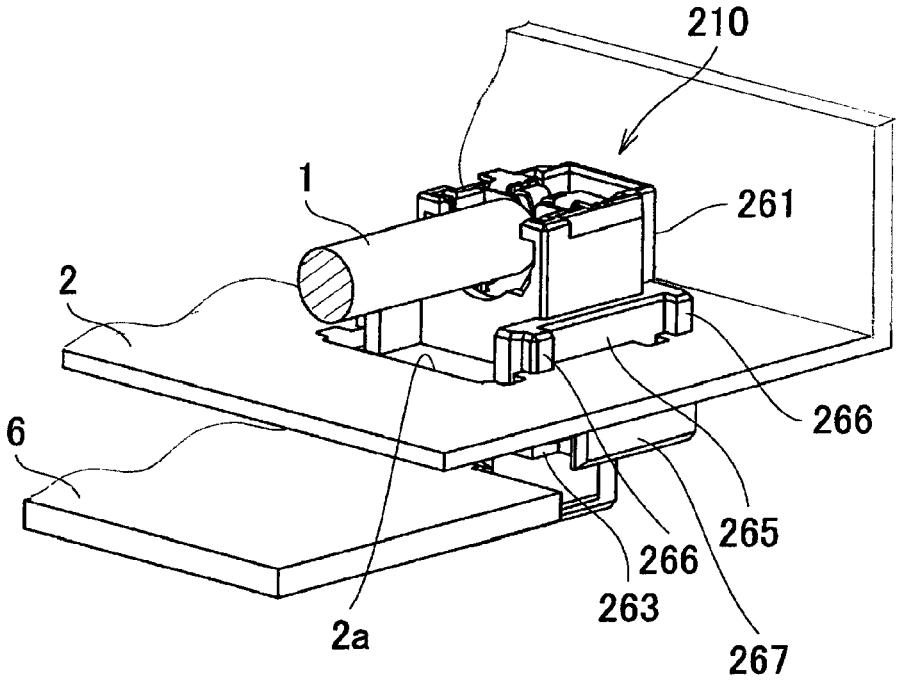
FIG. 15 is an enlarged perspective view of a fluorescent tube and a connector appearing in FIG. 14 in a state in which the former is connected to the latter.

As shown in FIGS. 14 and 15, connectors 210 are fixed to the cassis 2 at equally-spaced intervals. The connectors 210 are used in combination with the connectors 10 of the first embodiment, and electrically connect the fluorescent tubes 1 and a printed circuit board 6. The connector 10 of the first embodiment is used for connection with one of the pair of terminal portions 1*a* of the fluorescent tube 1, and the connector 210 of the second embodiment is used for connection with the other of the pair of terminal portions 1*a* of the fluorescent tube 1.

Figure 16:
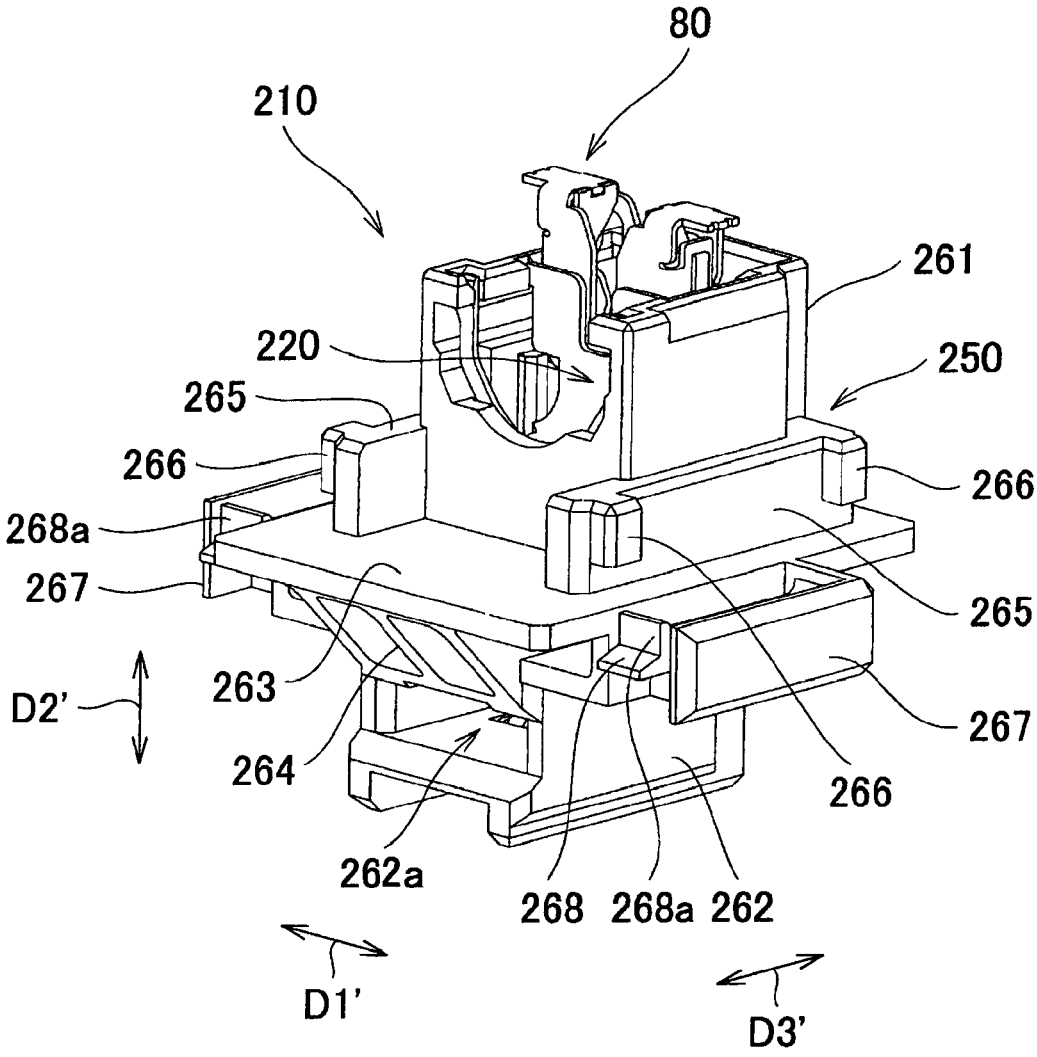
FIG. 16 is an enlarged perspective view of the connector appearing in FIG. 14.
Figure 17:
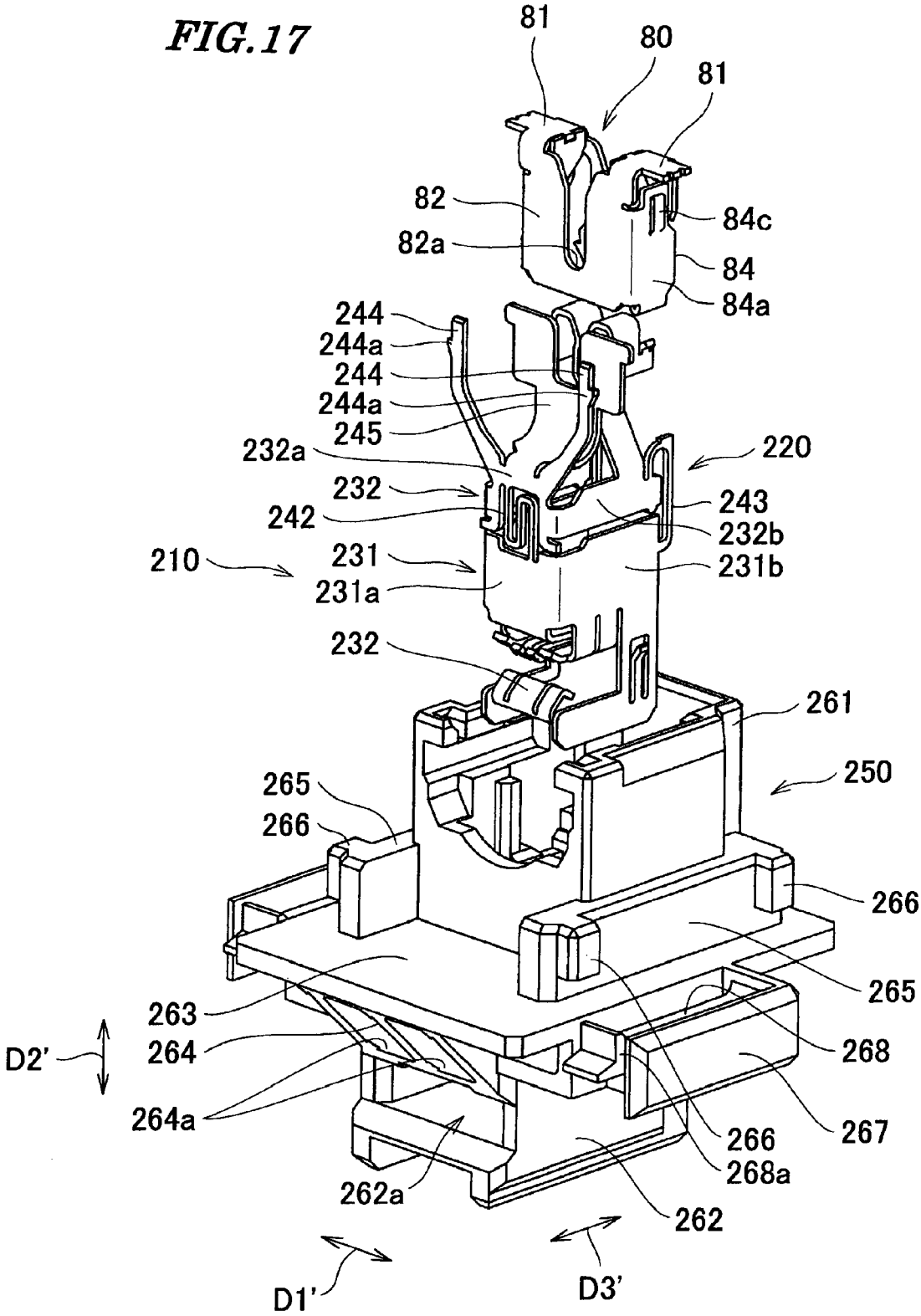
FIG. 17 is an exploded perspective view of the connector appearing in FIG. 16.

As shown in FIGS. 16 and 17, the connector 210 comprises a contact 220, a housing 250 (supporting member), and the operation member 80.

Figure 18:
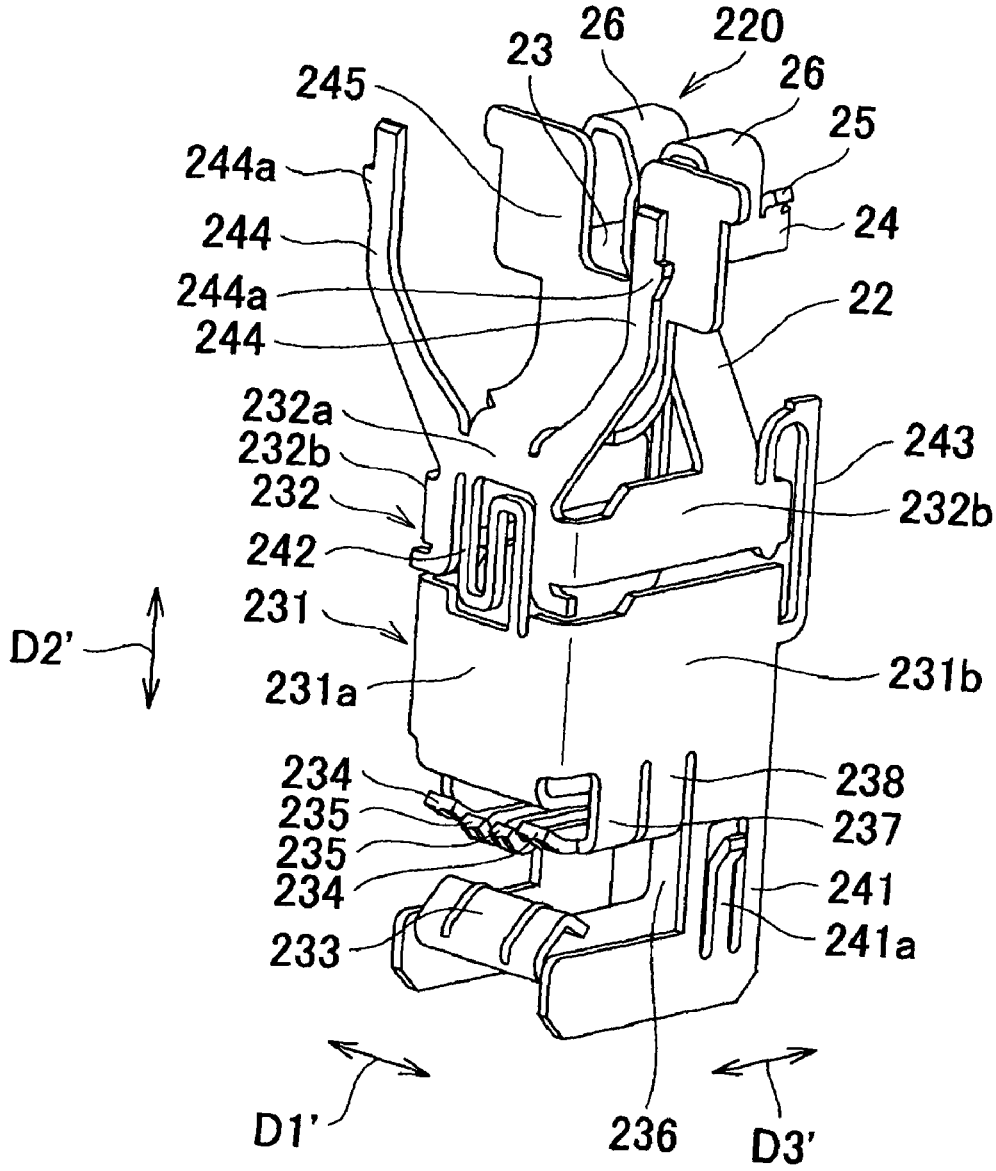
FIG. 18 is a perspective view of a contact of the connector appearing in FIG. 16.

As shown in FIG. 18, similarly to the contact 20 of the connector 10 of the first embodiment, the contact 220 includes the spring portions 22, the contact portions 23, the engaging portions 24, the guide portions 25, and the linking portions 26.

The contact 220 includes, in addition to the above-mentioned spring portions 22 and so forth, a fixing portion 231, a movable portion 232, a substrate contact portion (connection portion) 233, a pair of substrate guide portions 234, and a pair of substrate pressing portions 235. The contact 220 is formed by blanking and bending a metal plate.

The fixing portion 231 is held by the housing 250. The fixing portion 231 includes a front portion 231*a* and a pair of side portions 231*b*.

The movable portion 232 is accommodated in the housing 250 such that it is movable in a horizontal direction D1' of the housing 250 and in a front-rear direction D3' of the same.

The movable portion 232 includes a front portion 232*a* and a pair of side portions 232*b*. A pair of retaining portions 244 are continuous with an upper portion of the front portion 232*a*. The retaining portions 244 are each formed with a lug 244*a*. Further, a receiving portion 245 is continuous with the upper portion of the front portion 232*a*. The receiving portion 245 prevents the thermally-expanded fluorescent tube 1 from being directly brought into contact with the contact 220.

The substrate contact portion 233 is formed into a substantially C-shape in cross-section, and is brought into contact with a pad (not shown) of the printed circuit board 6. The substrate contact portion 233 is continuous with the front portion 231*a* of the fixing portion 231 via a linking portion 236.

The pair of substrate guide portions 234 are continuous with the side portions 231*b* of the fixing portion 231 via linking portions 237, respectively. When the printed circuit board 6 is inserted in the connector 210, the substrate guide portions 234 guide the printed circuit board 6 into the contact 220.

The pair of substrate pressing portions 235 are continuous with the side portions 231*b* via linking portions 238, respectively. The substrate pressing portions 235 press the printed circuit board 6 inserted in the connector 210 against the substrate contact portion 233.

L-shaped leg portions 241 are continuous with the pair of side portions 231*b* of the fixing portion 231, respectively. The leg portions 241 are each formed with a lug 241*a*.

The fixing portion 231 and the movable portion 232 are continuous with each other in a vertical direction D2' via a spring portion 242 and a pair of spring portions 243. The spring portion 242 is substantially S-shaped, and connects the front portion 231*a* of the fixing portion 231 and the front portion 232*a* of the movable portion 232. The spring portions 243 are each substantially C-shaped, and connect the side portions 231*b* of the fixing portion 231 and the side portions 232*b* of the movable portion 232, respectively.

Figure 19:
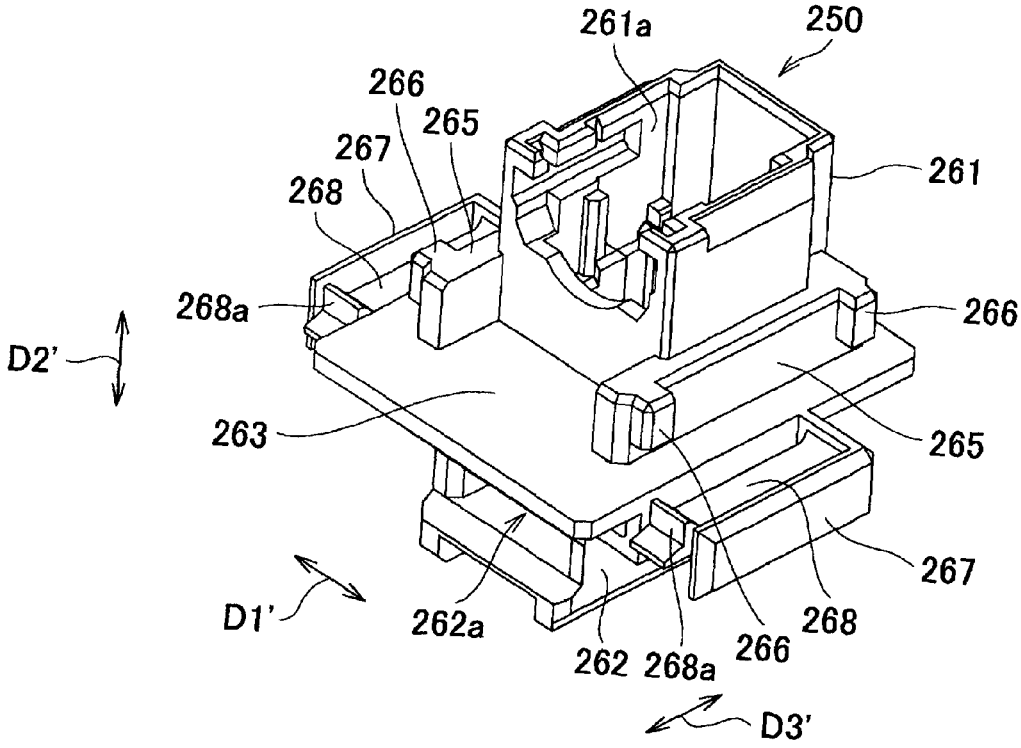
FIG. 19 is a perspective view of a housing of the connector appearing in FIG. 16.
Figure 20:
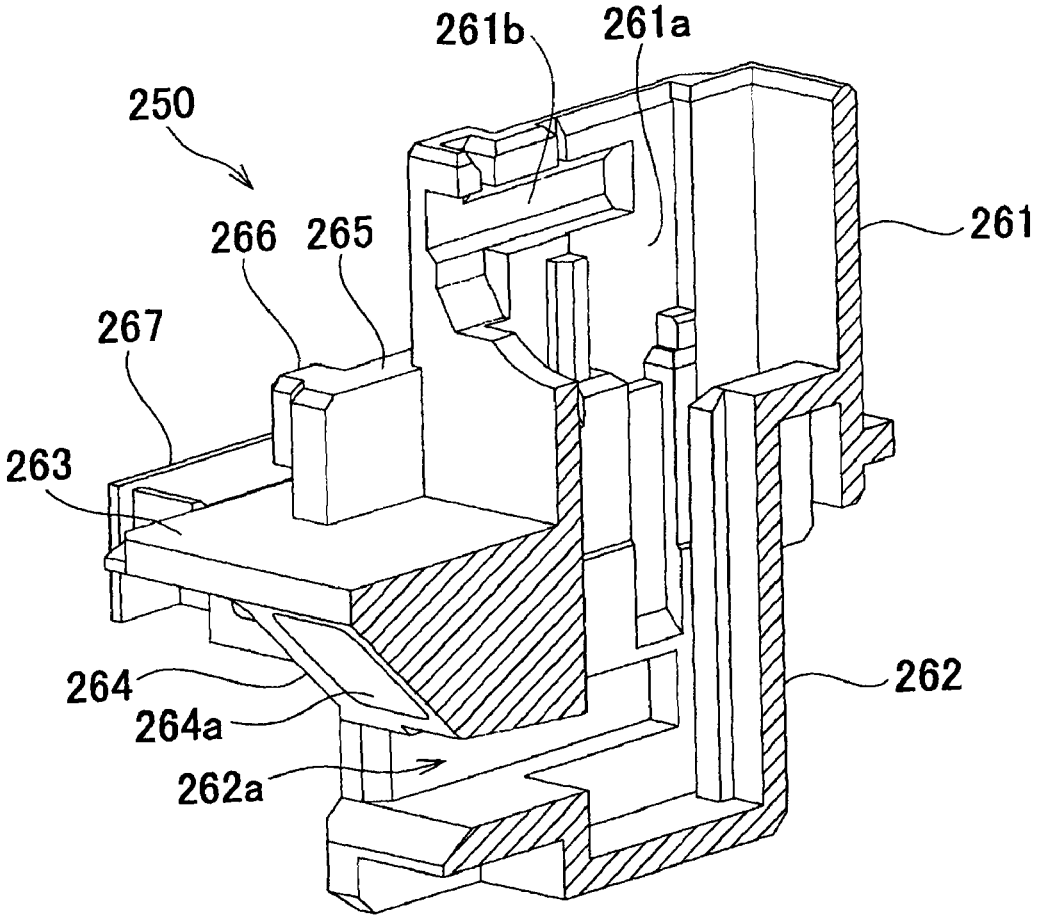
FIG. 20 is a cross-sectional view of the housing shown in FIG. 19.

As shown in FIGS. 19 and 20, the housing 250 is a one-piece member integrally formed of an insulating resin (insulator), and includes a first accommodating portion 261, a second accommodating portion 262, and a chassis supporting portion 263.

The first accommodating portion 261 has a recess 261*a*. The operation member 80 is accommodated in the recess 261*a* movably in the vertical direction D2' of the housing 250. Further, the first accommodating portion 261 is formed with recesses 261*b* which communicate with the recess 261*a* (see FIG. 21).

The second accommodating portion 262 has a substrate receiving space 262*a*. The substrate receiving space 262*a* receives part (not shown) of the printed circuit board 6 therein.

The chassis supporting portion 263 is substantially plate-shaped, and is disposed between the first accommodating portion 261 and the second accommodating portion 262. A lower surface of a front portion of the chassis supporting portion 263 is formed with a substrate guide portion 264. The substrate guide portion 264 is formed with two large lightening portions 264*a* (only one of which is shown in FIG. 20). When the printed circuit board 6 is inserted in the connector 210, the substrate guide portion 264 guides the part of the printed circuit board 6 into the substrate receiving space 262*a*.

An upper surface of the chassis supporting portion 263 is formed with a pair of projecting portions 265. The pair of projecting portions 265 extend in the front-rear direction D3', and sandwich the first accommodating portion 261 in the horizontal direction D1'. The opposite ends of each projecting portion 265 in the front-rear direction D3' are formed with chassis pressing portions 266, respectively. The distance between the lower surface of each chassis pressing portion 266 and the upper surface of the chassis supporting portion 263 is slightly larger than the thickness of the chassis 2. The opposite sides of the chassis supporting portion 263 are each formed with an L-shaped chassis supporting arm 267. The chassis supporting arm 267 is formed with an engaging arm 268. The engaging arm 268 extends in the front-rear direction D3'. A front end of the engaging arm 268 is formed with a lug 268*a*.

To assemble the connector 210, first, as shown in FIGS. 17 and 18, the contact 220 is inserted into the housing 250 from above the housing 250. As a result, the lugs 241*a* of the leg portions 241 and the lugs 244*a* of the retaining portions 244 of the contact 220 inserted in the housing 250 are hooked on the protrusions (not shown) formed on the inner surface of the housing 250, whereby the contact 220 is prevented from being easily removed from the housing 250.

Thereafter, the operation member 80 is inserted into the first accommodating portion 261 of the housing 250 from above the housing 250. As a result, the operation member 80 inserted in the housing 250 is supported movably in the vertical direction D2'.

Next, a description will be given of a method of mounting the connector 210 on the chassis 2. As shown in FIG. 15, each insertion hole 2*a* of the chassis 2 has a shape and size which enable the first accommodating portion 261, the projecting portions 265, and the chassis pressing portions 266 of the connector 210 to be received from under the chassis 2, such that the first accommodating portion 261 and the projecting portions 265 of the connector 210 can be slid rearward by a predetermined distance.

To mount the connector 210 on the chassis 2, first, the connector 210 is inserted into the insertion hole 2*a* from under the chassis 2. When the connector 210 is inserted into each insertion hole 2*a*, the chassis supporting portion 263 and the chassis supporting arms 267 of the connector 210 are brought into abutment with the lower surface of the chassis 2.

Thereafter, the connector 210 is slid rearward. When the connector 210 is slid rearward, the chassis pressing portions 266 of the housing 250 of the connector 210 climb on the upper surface of the chassis 2, whereby the connector 210 is prevented from being removed from the insertion hole 2*a* of the chassis 2. Further, when the connector 210 is slid rearward to thereby cause the lugs 268*a* (see FIG. 19) of the engaging arms 268 to be relatively moved over the protrusions (not shown) provided on the lower surface of the chassis 2, the connector 210 is prevented from moving forward due to the function of the protrusions, whereby the connector 210 is fixed to the chassis 2.

To connect the fluorescent tube 1 to the connector 210, part (not shown) of the printed circuit board 6 is inserted in the substrate receiving space 262*a* of the second accommodating portion 262 of the housing 250 of the connector 210, in advance.

Figure 21:
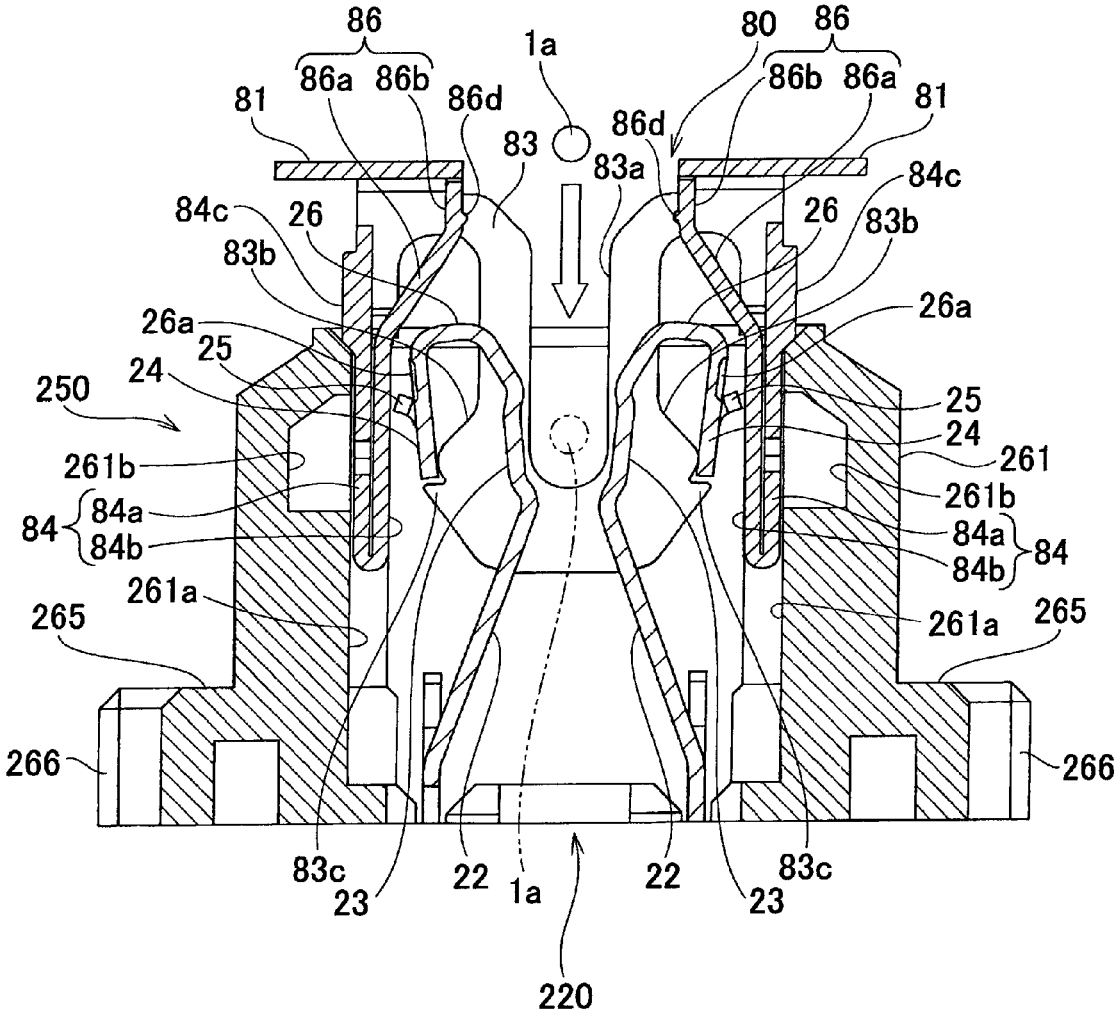
FIG. 21 is a schematic view of the connector appearing in FIG. 16 and the fluorescent tube in a state before the contact of the connector is brought into contact with a terminal portion of the fluorescent tube.

Next, the operation member 80 is pulled upward by holding the operation portions 81 by hand or the like. Then, as shown in FIG. 21, the lugs 83*c* of the operation member 80 are brought into abutment with the engaging portions 24 of the contact 20, whereby the operation member 80 stops at the first predetermined position. At this time, the cam faces 83*b* of the linking portion 83 of the operation member 80 press the engaging portions 24 of the contact 20, whereby the space between the pair of contact portions 23 is widened.

When the operation member 80 is in the first predetermined position, even if the operation portions 81 are released from hand, the lower end of the protrusions 84*c* of the operation member 80 are brought into abutment with the upper end of the first accommodating portion 261 of the housing 250, which prevents the operation member 80 from moving downward.

When the operation member 80 is in the first predetermined position, the terminal portion 1*a* of the fluorescent tube 1 is inserted between the pair of contact portions 23.

Figure 22:
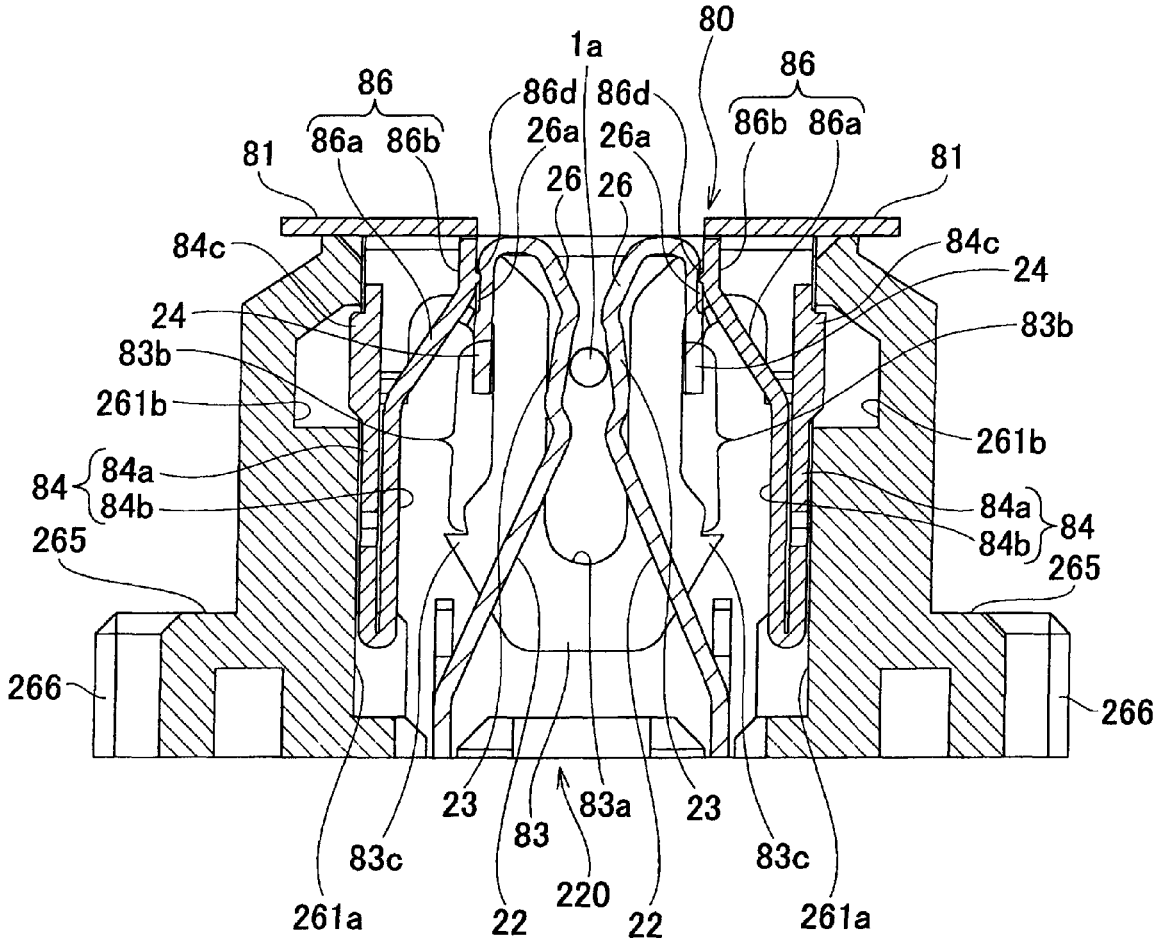
FIG. 22 is a schematic view of the connector appearing in FIG. 16 and the fluorescent tube in a state in which the contact of the connector is brought into contact with the terminal portion of the fluorescent tube.

Next, the operation member 80 is pushed down by pressing the operation portions 81 of the operation member 80 downward. Then, the protrusions 84*c* of the operation member 80 enter the housing 250, and as shown in FIG. 22, are fitted in the recesses 261*b* of the first accommodating portion 261, whereby the operation member 80 stops at the second predetermined position. During this time, the linking portions 26 of the contact 220 is pressed by the inclined portions 86*a* of the pressing portions 86 of the operation member 80, whereby the space between the pair of contact portions 23 is made gradually narrower, and finally, the vertical portions 86*b* of the pressing portions 86 are brought into contact with the linking portions 26, respectively, with the terminal portion 1*a* being held by the pair of contact portions 23 in a sandwiched manner. As a result, the fluorescent tube 1 becomes electrically continuous with the connector 210, thereby being electrically connected to the printed circuit board 6 via the connector 210. Although when the operation member 80 is in the second predetermined position, the pressing portions 86 of the operation member 80 are subjected to a load from the linking portions 26 of the contact 220, the load is dispersed through the first linking portion 82 and the second linking portion 83 in the directions perpendicular to the direction (horizontal direction D1') of thickness of the first and second linking portions 82 and 83, and hence the space between the two pressing portions 86 is hardly widened.

When the operation member 80 is in the second predetermined position, as shown in FIG. 22, protrusions 86*d* formed on the vertical portions 86*b* of the pressing portions 86 of the operation member 80 are fitted in recesses 26*a* formed in the linking portions 26 of the contact 20, and the protrusions 84*c* of the operation member 80 are fitted in the recesses 261*b* of the first accommodating portion 261, which prevents the operation member 80 from unexpectedly moving from the second predetermined position to the first predetermined position.

According to the second embodiment, it is possible to obtain the same advantageous effects as provided by the first embodiment, and at the same time, since the contact 220 includes the movable portion 232, the movable portion 232 can follow expansion and contraction of the fluorescent tube 1 due to changes in temperature of the fluorescent tube 1, whereby it is possible to prevent friction between the contact 220 and the fluorescent tube 1 when the fluorescent tube 1 expands and contracts. As a result, it is possible to suppress contact failure due to generation of abrasion powder, and generation of a friction sound.

Further, since the contact 220 and the operation member 80 are accommodated in the housing 250 made of insulating resin, the connector 210 provides excellent insulation, and can be used as a high-voltage side connector of the fluorescent tube 1.

Next, a description will be given of an operation member of a connector according to a third embodiment of the present invention with reference to FIGS. 23 and 24.

Component parts identical to those of the connector according to the first embodiment are designated by identical reference numerals, and detailed description thereof is omitted, while only main component parts different in construction from those of the first embodiment will be described hereinafter.

Figure 23:
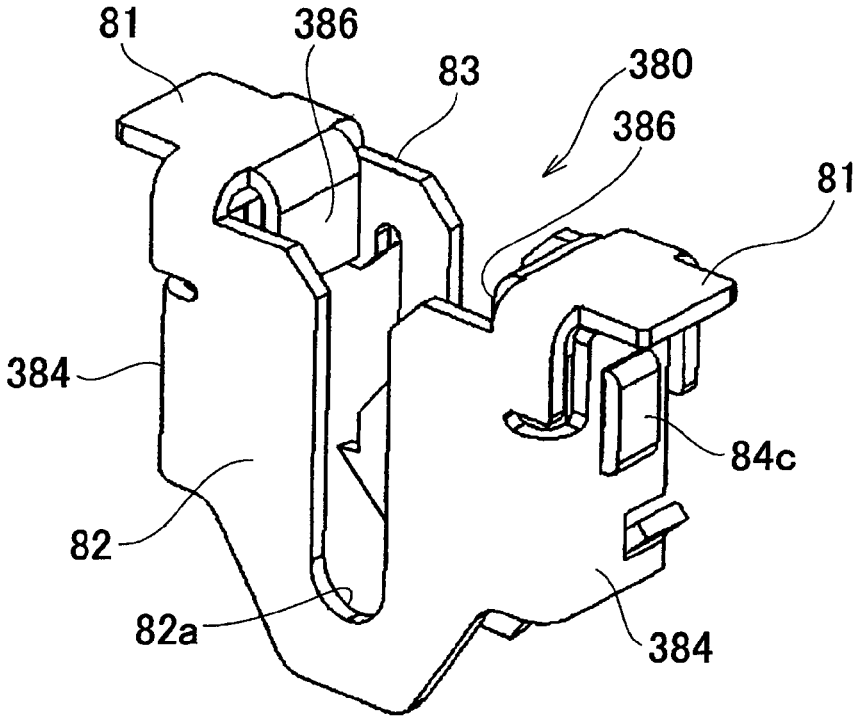
FIG. 23 is a perspective view of an operation member of a connector according to a third embodiment of the present invention, as viewed from the front.
Figure 24:
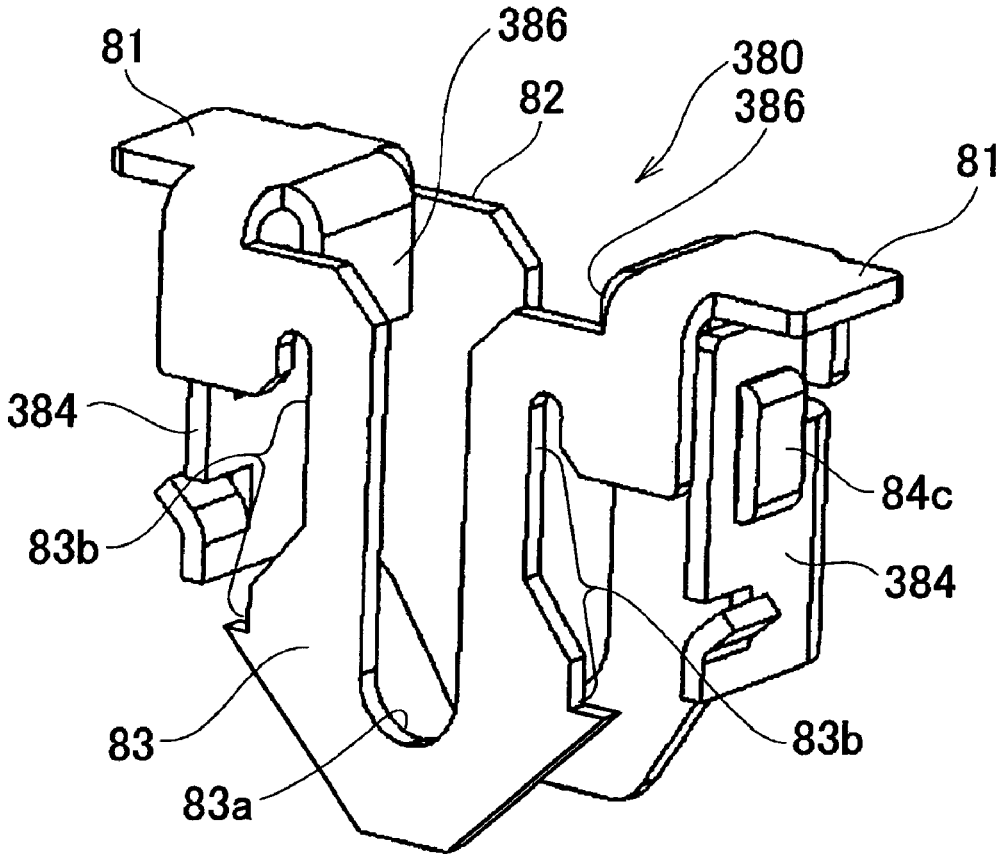
FIG. 24 is a perspective view of the operation member shown in FIG. 23 as viewed from the rear.

Although in the operation member 80 of the first embodiment, each operation portion 81 and the associated pressing portion 86 are connected by engagement, in an operation member 380 of the third embodiment, as shown in FIGS. 23 and 24, each pressing portion 386 continuously extends from the associated operation portion 81, and the operation portion 81 and the pressing portion 386 are integrally connected. The pressing portions 386 extend in parallel to side portions 384.

Further, although in the first embodiment, the operation member 80 of each side portion 84 is folded back, and includes the outer portion 84*a* and the inner portion 84*b*, in the third embodiment, each side portion 384 of the operation member 380 is not folded back.

According to the third embodiment, it is possible to make the area in the developed shape of the operation member 380 smaller than that of the operation member 80 in the first embodiment, and hence it is possible to make a used amount of a metal plate less than that in the first embodiment, thereby making it possible to obtain cost efficiency.

Figure 25:
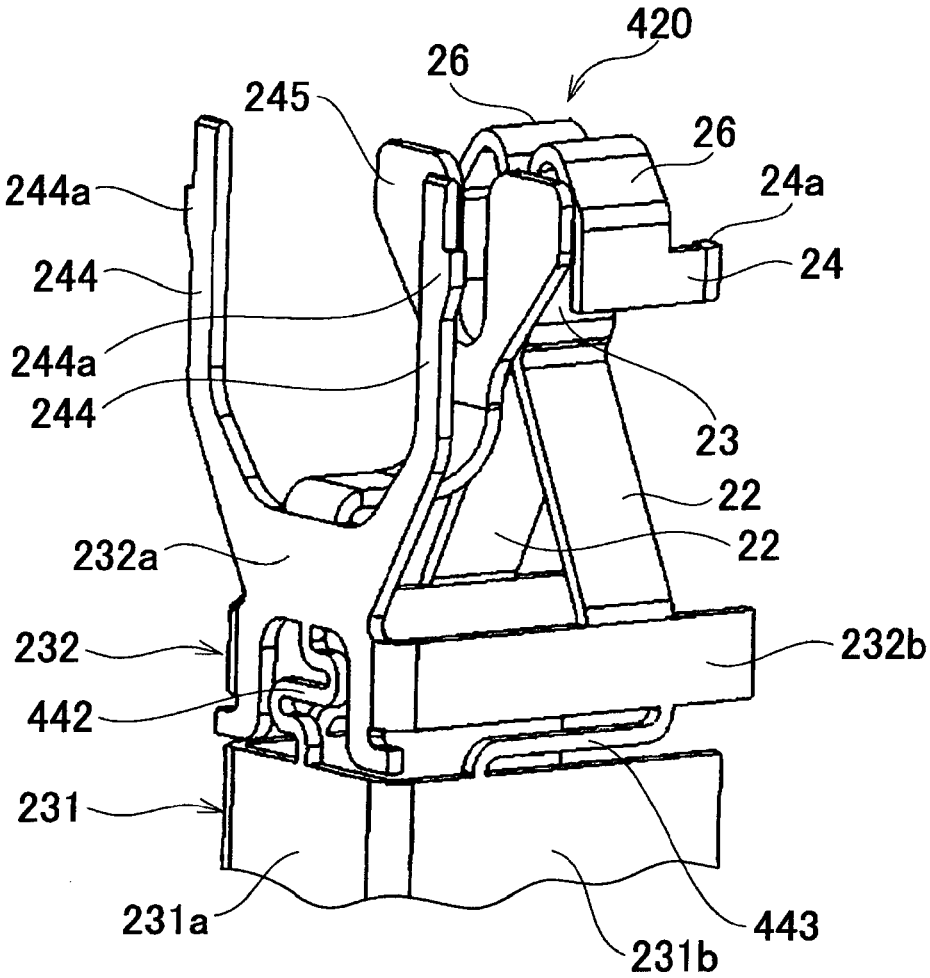
FIG. 25 is a perspective view of a contact of a connector according to a fourth embodiment of the present invention as viewed from the front.
Figure 26:
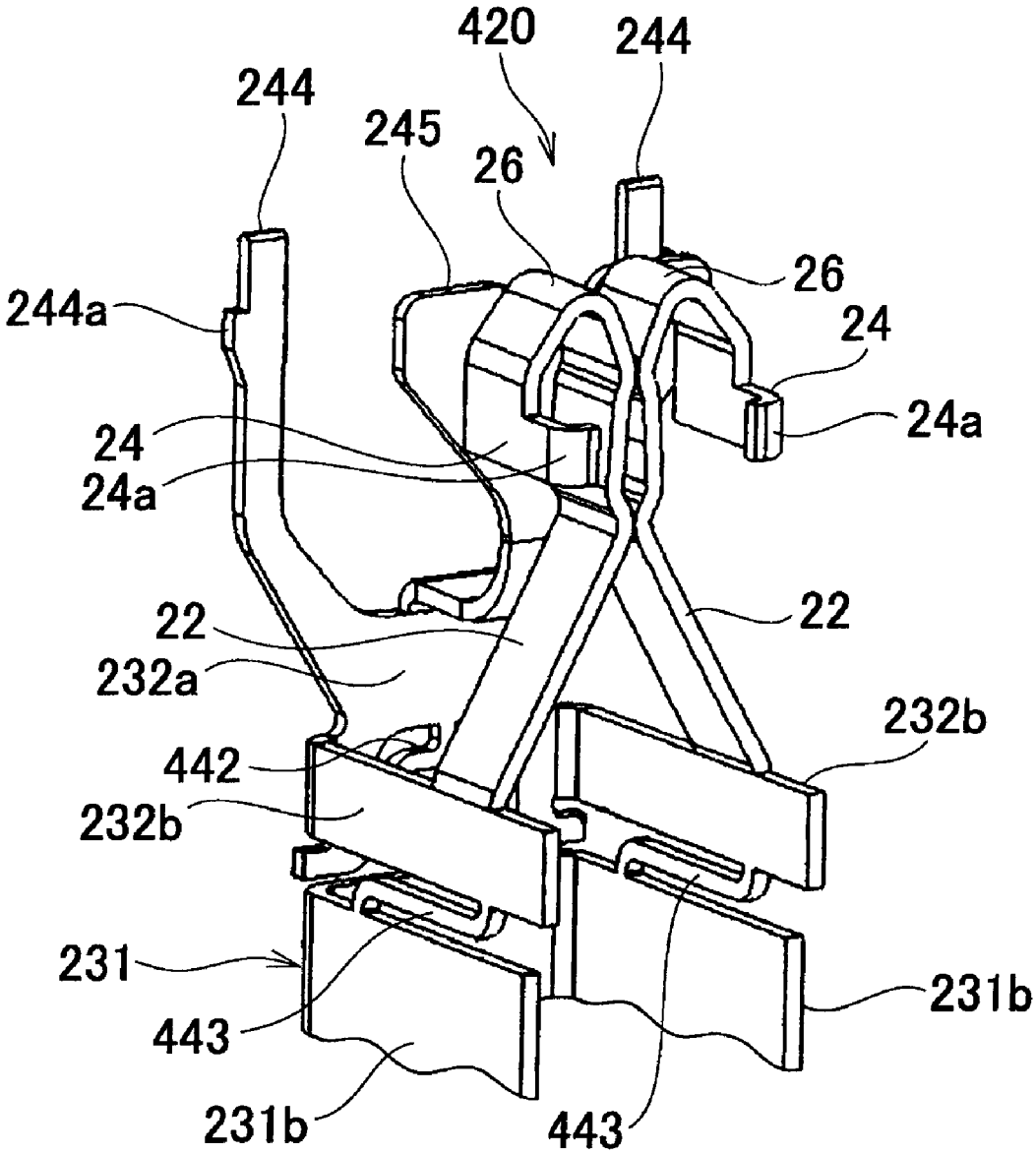
FIG. 26 is a perspective view of the contact shown in FIG. 25, as viewed from the rear.

A description will be given of a contact of a connector according to a fourth embodiment of the present invention with reference to FIGS. 25 and 26.

Component parts identical to those of the connector according to the second embodiment are designated by identical reference numerals, and detailed description thereof is omitted, while only main component parts different in construction from those of the second embodiment will be described hereinafter.

In the second embodiment, each spring portion 243 of the contact 220 links the rear end portion of the associated side portion 231*b* of the fixing portion 231 and the rear end portion of the associated side portion 232*b* of the movable portion 232, and protrudes outside from the rear ends of the respective side portions 231*b* and 232*b* (see FIG. 18). In contrast, in the fourth embodiment, a contact 420 of the connector, as shown in FIGS. 25 and 26, has each spring portion 443 thereof disposed in a manner sandwiched by the associated side portion 231*b* and the associated side portion 232*b* in a direction of the height of the contact 420, and does not protrude outside.

Further, a spring portion 442 is also disposed in a manner sandwiched by the front portion 231*a* and the front portion 232*a* in the direction of the height of the contact 420.

According to the fourth embodiment, since the spring portions 442 and 443 do not protrude outside the contact 420, it is possible to make the size of the housing for accommodating the contact 420 smaller than the housing 250 of the connector 210 according to the second embodiment.

It should be noted that although in the above-described embodiments, the operation members 80 and 380 are each formed by blanking and bending a metal plate, it is not necessarily required to make the operation member of a metal plate.

Further, although in the first embodiment, the contact 20 and the housing 50 are integrally formed, it is not necessarily required to integrally form the contact 20 and the housing 50, but the contact 20 and the housing 50 may be separately formed.

Although the connectors according to the first and third embodiments are each mainly used for connection with one of a pair of terminal portions of a fluorescent tube, and the connectors according to the second and fourth embodiments are each mainly used for connection with the other of the pair of terminal portions of the fluorescent tube, the connectors according to the first and third embodiments may be used for connection with both of the pair of terminal portions of the fluorescent tube.

Further, although in the third embodiment, each pressing portion 386 is integrally connected to the end portion of each operation portion 81 toward the hole 80*a*, as a variation of the third embodiment, a pressing portion (not shown) may be connected to each operation portion 81 by integrally connecting the pressing portion to an end portion of the operation portion 81 on an opposite side from the hole 80*a*, bending the pressing portion into a substantially V-shape under the operation portion 81, and engaging a front end portion of the pressing portion with the end portion of the operation portion 81 toward the hole 80*a*.

It is further understood by those skilled in the art that the foregoing are the preferred embodiments of the present invention, and that various changes and modification may be made thereto without departing from the spirit and scope thereof.

What is claimed is:

1. A connector comprising:

a contact that includes a pair of contact portions which are arranged in a manner opposed to each other in a first predetermined direction, and are capable of holding a terminal portion of an object to be connected, in a sandwiching manner;

an operation member that accommodates said pair of contact portions and operates said pair of contact portions, said operation member including:

a pair of operation portions that are arranged in a manner opposed to each other in the first predetermined direction, a first linking portion that has a cutout enabling the terminal portion of the object to be connected to be inserted between said pair of contact portions in a second predetermined direction which is perpendicular to the first predetermined direction, and links said pair of operation portions, a second linking portion that is opposed to said first linking portion in a third predetermined direction which is perpendicular to the first and second predetermined directions, and links said pair of operation portions, and a pair of pressing portions that are connected to said operation portions, respectively, and are arranged in a manner opposed to each other in the first predetermined direction, for pressing said pair of contact portions to cause said pair of contact portions to be made close to each other such that said pair of contact portions hold the terminal portion of the object to be connected in a sandwiching manner, when said operation member is moved from a first predetermined position to a second predetermined position; and a supporting member that supports said operation member in a manner movable between the first predetermined position and the second predetermined direction in which said pair of pressing portions cause said pair of contact portions to be made close to each other.

2. The connector as claimed in claim 1, wherein each operation portion and each pressing portion are connected by engaging each operation portion and each pressing portion.

3. The connector as claimed in claim 1, wherein each pressing portion and each operation portion are connected by integrally forming said pressing portion and said operation portion such that said pressing portion extends from said operation portion.

4. The connector as claimed in claim 1, wherein said contact includes a connection portion that is connected to another object to be connected, and wherein said contact and said supporting member are integrally formed by blanking and bending a metal plate.

5. The connector as claimed in claim 2, wherein said contact includes a connection portion that is connected to another object to be connected, and wherein said contact and said supporting member are integrally formed by blanking and bending a metal plate.

6. The connector as claimed in claim 3, wherein said contact includes a connection portion that is connected to another object to be connected, and wherein said contact and said supporting member are integrally formed by blanking and bending a metal plate.

7. The connector as claimed in claim 1, wherein said contact includes a connection portion that is connected to another object to be connected, and wherein said supporting member is formed of an insulator.

8. The connector as claimed in claim 2, wherein said contact includes a connection portion that is connected to another object to be connected, and wherein said supporting member is formed of an insulator.

9. The connector as claimed in claim 3, wherein said contact includes a connection portion that is connected to another object to be connected, and wherein said supporting member is formed of an insulator.

10. The connector as claimed in claim 1, wherein said operation member is formed by blanking and bending a metal plate.

11. The connector as claimed in claim 2, wherein said operation member is formed by blanking and bending a metal plate.

12. The connector as claimed in claim 3, wherein said operation member is formed by blanking and bending a metal plate.

13. The connector as claimed in claim 10, wherein when said operation member is in a developed state, said first and second linking portions are disposed in an arrangement in which said first and second linking portions sandwich said pair of operation portions, and wherein when said operation member is in a completed state, said first and second linking portions are bent at right angles with respect to said pair of operation portions, respectively.

14. The connector as claimed in claim 11, wherein when said operation member is in a developed state, said first and second linking portions are disposed in an arrangement in which said first and second linking portions sandwich said pair of operation portions, and wherein when said operation member is in a completed state, said first and second linking portions are bent at right angles with respect to said pair of operation portions, respectively.

15. The connector as claimed in claim 12, wherein when said operation member is in a developed state, said first and second linking portions are disposed in an arrangement in which said first and second linking portions sandwich said pair of operation portions, and wherein when said operation member is in a completed state, said first and second linking portions are bent at right angles with respect to said pair of operation portions, respectively.

* * * * *

UNITED STATES PATENT AND TRADEMARK OFFICE

CERTIFICATE OF CORRECTION

PATENT NO. : 8,087,947 B2
APPLICATION NO. : 12/985519
DATED : January 3, 2012
INVENTOR(S) : Tetsu Urano It is certified that error appears in the above-identified patent and that said Letters Patent is hereby corrected as shown below:

On the Title page:

Item (57) Abstract, (line 9);

delete "connecting the"

Signed and Sealed this
Tenth Day of July, 2012

David J. Kappos

David J. Kappos
*Director of the United States Patent and Trademark Office*